US008245339B2

(12) United States Patent
Murray et al.

(10) Patent No.: US 8,245,339 B2
(45) Date of Patent: Aug. 21, 2012

(54) CUSHIONING DEVICE

(75) Inventors: Ted F. Murray, Granger, IN (US); Jeffrey D. Martin, Boynton Beach, FL (US); Daniel B. Schecter, Richmond, VA (US)

(73) Assignee: Carpenter Co., Richmond, VA (US)

( * ) Notice: Subject to any disclaimer, the term of this patent is extended or adjusted under 35 U.S.C. 154(b) by 340 days.

(21) Appl. No.: 11/730,577

(22) Filed: Apr. 2, 2007

(65) Prior Publication Data

US 2008/0235877 A1 Oct. 2, 2008

(51) Int. Cl.
*A47G 9/00* (2006.01)

(52) U.S. Cl. ..... 5/657

(58) Field of Classification Search ..... 5/413 R, 5/490, 491, 500, 502, 636, 640, 655, 655.9, 5/657

See application file for complete search history.

(56) References Cited

U.S. PATENT DOCUMENTS

| | | | | | |
|---|---|---|---|---|---|
| 848,437 | A | * | 3/1907 | Brown | 5/690 |
| 1,447,288 | A | * | 3/1923 | Emmerich | 5/645 |
| 2,805,428 | A | | 9/1957 | Buchman | |
| 2,815,515 | A | | 12/1957 | McKinley | |
| 3,148,389 | A | | 9/1964 | Lustig | |
| 3,216,028 | A | * | 11/1965 | Lawson | 5/638 |
| 3,242,511 | A | * | 3/1966 | Fultz et al. | 5/655.9 |
| 3,648,308 | A | | 3/1972 | Greenawalt | |
| 3,849,810 | A | * | 11/1974 | Degen | 5/640 |
| 4,190,697 | A | | 2/1980 | Ahrens | |
| 4,207,636 | A | | 6/1980 | Ceriani | |
| 4,494,261 | A | | 1/1985 | Morrow | |
| 4,688,286 | A | * | 8/1987 | Miker, Jr. | 5/490 |
| 4,706,313 | A | | 11/1987 | Murphy | |
| 4,748,702 | A | | 6/1988 | Sandler | |
| 4,753,480 | A | | 6/1988 | Morell | |
| 4,754,513 | A | | 7/1988 | Rinz | |
| 4,768,251 | A | | 9/1988 | Baskent | |
| 4,777,855 | A | | 10/1988 | Cohen | |
| 4,829,614 | A | | 5/1989 | Harper | |
| 4,843,666 | A | | 7/1989 | Elesh et al. | |
| 4,874,340 | A | * | 10/1989 | Smallwood | 446/28 |
| 4,947,500 | A | | 8/1990 | Seiler | |
| 4,960,304 | A | | 10/1990 | Frantz | |
| 5,016,303 | A | | 5/1991 | Tanaka et al. | |
| 5,107,558 | A | | 4/1992 | Luck | |
| 5,271,114 | A | * | 12/1993 | Kjersem | 5/640 |
| 5,474,362 | A | | 12/1995 | Albecker, III | |

(Continued)

FOREIGN PATENT DOCUMENTS

FR 2 305 956 4/1975

(Continued)

*Primary Examiner* — Gilbert Lee
(74) *Attorney, Agent, or Firm* — Smith, Gambrell & Russell, LLP

(57) ABSTRACT

A cushioning device with double layer cover with the layers connected to define first and second pockets. The first and second pocket having access openings for insertion and removal of shell sections to be placed in a stacked state. A closure device as in a zipper for adjustable placement of the cover in a cover interior cavity closure state and a cover interior cavity access state. A first core insert received within the cover interior cavity. The arrangement of the present invention makes it well suited for use as an adjustable head pillow kit featuring a variety of different comfort level core inserts that can be switched out to achieve a personal overall comfort level. A method of assembling the cushion and adjusting the comfort level with different inserts is also presented.

30 Claims, 15 Drawing Sheets

U.S. PATENT DOCUMENTS

| | | | | |
|---|---|---|---|---|
| 5,689,844 | A | 11/1997 | Liu | |
| 5,918,333 | A * | 7/1999 | Takashima | 5/641 |
| 5,987,675 | A | 11/1999 | Kim | |
| 6,050,265 | A * | 4/2000 | Richardson | 128/845 |
| 6,182,312 | B1 | 2/2001 | Walpin | |
| 6,230,347 | B1 | 5/2001 | Alexander | |
| 6,327,725 | B1 | 12/2001 | Veilleux et al. | |
| 6,578,218 | B2 | 6/2003 | Wassilefsky | |
| 6,704,953 | B2 * | 3/2004 | Fishman | 5/413 R |
| 6,918,146 | B2 * | 7/2005 | England | 5/653 |
| 6,952,852 | B2 | 10/2005 | Reeder et al. | |
| 6,988,286 | B2 * | 1/2006 | Schecter et al. | 5/645 |
| D549,282 | S * | 8/2007 | Nakamura | D19/26 |
| D551,704 | S * | 9/2007 | Nakamura | D19/26 |
| 7,404,219 | B2 * | 7/2008 | Berkey | 5/98.1 |
| 2003/0226205 | A1 * | 12/2003 | Fishman | 5/413 R |
| 2007/0174969 | A1 * | 8/2007 | Nakamura | 5/640 |
| 2007/0289060 | A1 * | 12/2007 | Berkey | 5/99.1 |

FOREIGN PATENT DOCUMENTS

| | | | |
|---|---|---|---|
| GB | 999217 | * | 7/1965 |

* cited by examiner

FIG. 11A
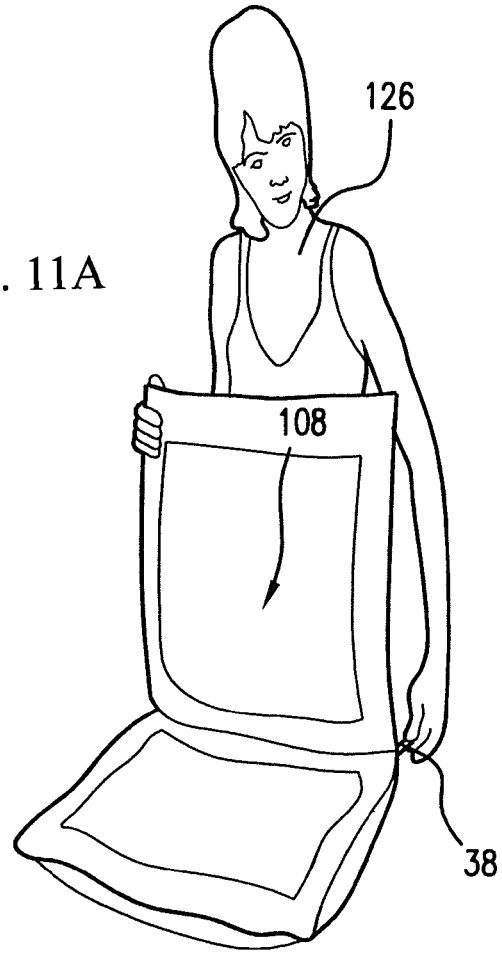
S1 UNZIP TO OPEN
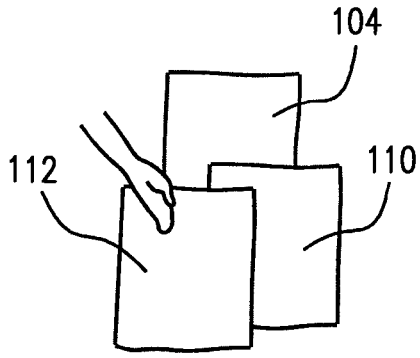
S2 SELECT COMFORT LEVEL
FIG. 11B
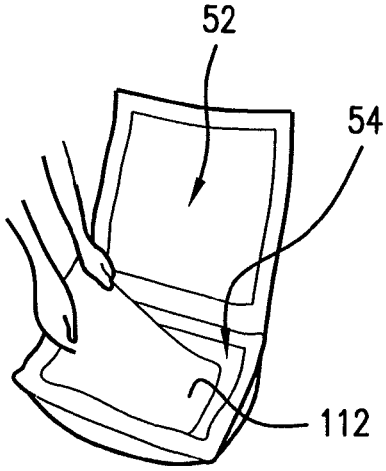
S3 INSERT THE PERFECT COMFORT CORE FOR YOU
FIG. 11C
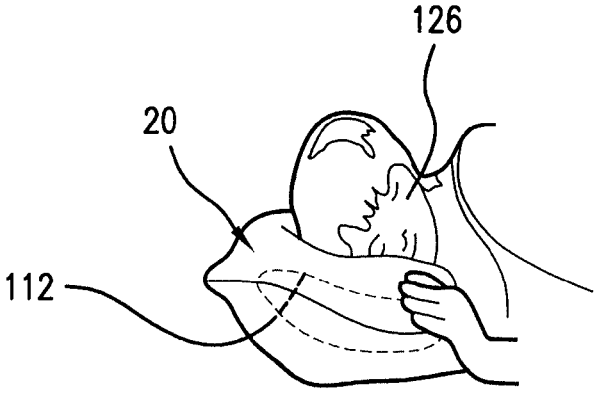
S4 ENJOY CUSTOMIZED COMFORT ALL NIGHT FOR A DEEPER AND MORE RESTORATIVE SLEEP
FIG. 11D

CUSHIONING DEVICE

FIELD OF THE INVENTION

The present invention relates to a cushioning device that is adaptable for easy adjustment in comfort with a preferred embodiment being a comfort adjustment pillow as in an adjustable combination shell and core bed pillow with readily insertable different core types to provide a cushioning device in the form of a comfort adjusting pillow kit.

BACKGROUND OF THE INVENTION

A conventional pillow generally includes a flexible outer enclosing layer or tick often made of fabric and encasing a resilient filler which may be of a unit of continuous nature such as a sponge rubber or foamed synthetic elastomeric block or may be of a non-continuous nature as in down, resilient or natural fibers or particles (e.g., ground foam particles). A variety of factors go into the comfort level a user associates with a particular pillow as in the materials utilized, the density of the cushioning materials used (individually and in combination), the firmness (e.g., Indentation Force Deflection or "IFD"—again either individually or in overall combination), the shape (e.g., thickness, depth, or general configuration), etc. These factors also combine together to provide a user with a particular feel which forms part of the overall comfort level a user associates with a particular pillow. The same holds true for other types of cushioning devices as in seat cushions, but is particularly pronounced relative to the extended direct face or head contact associated with head pillows.

The comfort level that a particular user desires in a pillow to meet that individual's sleeping needs, varies from person to person as well as on a time basis with respect to one user as a person's pillow support needs can change on a seasonal basis and even on a night to night basis. People can also be very adamant about having the right pillow and can find great discomfort and sleep poorly if the pillow does not meet the user's desired comfort level. Some user's also have medical conditions that favor one comfort characteristic over another in a pillow, as in a person with a spine problem may prefer a different firmness level over one not having such a medical condition. The desired comfort level can also be a matter of habit or what a user has grown accustomed to over the years. Thus, a pillow that has one type of comfort elements combination may be deemed the most preferred by one person only to be felt by another to be a poor choice.

The comfort level that a person feels relative to a particular cushion device can also vary over time in the pillow itself as in individual filler material clumping and even larger internal cushion elements moving in position within the pillow as well as a general degradation in quality of a cushioning element such as a break down in a fiber or particle filler element.

There also exists adjustable air bladder insert pillow embodiments which can provide a degree of variation when provided with means to adjust the pressure level (ball pump with one way valve), which may be favored by some; but for other individuals the "feel" attributed to such a pillow renders it non-desirable, which might be attributed, in part, to the combination of cushioning material characteristics relative to the layering often involved (e.g., plastic bladder skin/foam cover), and the heat retention or release characteristics associated with the comfort elements combination involved.

Additional factors associated with a person's comfort level with a pillow include cleanliness, which often is closely associated with the ease of cleaning the pillow (e.g., some pillows render it difficult to clean due to the material that is used and/or how materials are used in combination within the pillow (e.g., a non-accessible single tick outer covering with loose filler down is an example of a difficult to clean pillow while some foams with high heat retention may cause cleaning needs in short time frames due to perspiration build up, etc.)). While a cleanliness level is certainly desirable for individuals at home, other facilities such as hotels are subject to even higher requirements for making sure there pillows are clean and, from a cost standpoint, it will be important to those facilities that cleaning the cushions can be readily accomplished (a pillow that is not easily broken down and/or reassembled when certain pillow parts are subject to cleaning or more frequent cleaning is undesirable).

SUMMARY OF INVENTION

The inventive subject matter is directed at providing a cushion device that provides a high comfort level and which is also preferably adjustable to provide for easy alteration amongst a variety of different comfort levels as by providing a shell assembly that can be readily made accessible to different types of core inserts with varying comfort characteristics and/or altering shell components of a stacked shell assembly (providing for the formation of a shell cavity in which the core insert is positioned and preferably retained from movement by way of a close, contact fit relationship between the core insert and the shell cavity formed). The shell assembly with single core insert in and of itself provides a high comfort pillow, but can also be provided with a set of different type core inserts to even expand upon the potential for user adjustment to a desired comfort model.

In a preferred embodiment, the shell assembly design, in conjunction with the core insert shape and size, also provides for a conformance cavity in the shell assembly that closely matches the exterior shape of the core insert to avoid undesirable relative position adjustment in the component parts of the cushion device which preferably is a pillow kit with multiple core inserts.

An embodiment to the present invention features a versatile cushioning device as in a bed pillow that has a cover having an exterior layer and an interior layer, the interior layer and the exterior layer being connected as to define first and second pockets, the first pocket including an access opening, and the second pocket including an access opening. A closure device, as in a zipper, is provided for adjustable placement of the cover in either a cover interior cavity closure state and/or a cover interior cavity access state. A first shell section is releasably received in the first pocket and is readily inserted and removed relative to the access opening in the first pocket. A second shell section is releasably received in the second pocket and is insertable and removable relative to the access opening in the second pocket. A first core insert is received within the cover interior cavity.

The arrangement of the present invention provides for a pillow that can be easily opened and closed to gain access to a core insert and/or one of the shell sections that are releasably retained by the pockets formed by an interior layer of a double layer cover. In addition to providing for ease in comfort level adjustment by switching out shell sections(s) and/or core inserts, the ability to be able to easily breakdown and reassemble the cushion device provides for ease in cleaning components of the pillow that are more readily cleaned than other components as in cleaning the cover while foam bodies in the interior insert cavity provided by the cover can be removed as cushion components less easily cleaned.

Further a preferred embodiment features foam shell sections that have opposing rim surfaces that are matching in shape and size to provide, when stacked, the formation of a sealable shell cavity for core insert placement. The stacking arrangement of the shell assembly with core insert also provides a high comfort performance stacking of layers of different types of material.

In a preferred embodiment featuring a single layer outer and inner layer cover with pockets formed therein, the cover can be folded over onto itself with the shell sections received in the respective pockets after a core insert is placed onto the interior cover layer material positioned over the reception recess formed in the shell section. Thus, the outer cover keeps all components in place while the pockets formed between the inner and outer layers of the cover maintain the shell sections in position while the shell sections, with their recessed regions, keep the core insert in a desired position.

The present invention also provides for ease in manufacture as in, with respect to one embodiment, having the inner single cover layer formed of a pair of parallel running strips of material with a slight overlap and with a central stitch provided as a means of connecting the intermediate areas of the interior and exterior cover layers while the exterior of the cover layers are connected at their peripheral edges as by way of connection to an intermediate zipper assembly.

The shell sections and/or core inserts are preferably formed by way of a foam material molding process wherein the shell sections are preferably formed with the same shape and size as to provide a universal approach as where a single type shell section can be used for both the first and second shell sections described above. Also, forming the shell sections with a common mold design and preferably at least two of a set of the core inserts for a pillow kit in a common core insert mold design provides for manufacturer versatility of the cushioning device. For example, there can be provided a variety of shell sections and/or core combination as in using different shell materials (on same pillow or different pillow) and provide interchangeable core inserts as in a set of three foam core inserts all of the same size and shape but with low, medium and high firmness characteristics. The foam core inserts are also preferably covered with their own ticking as to form mini-pillows suitable for receipt between an "upper" stack combination comprising an exterior cover layer, first shell section and interior cover layer stack combination and a lower stack combination comprising an interior cover layer, second shell section and exterior cover layer.

Thus, a user can pick and choose different firmness levels to suit that person's personal needs and then readily change the pillow comfort level characteristic when that person's comfort level choice changes or a second person desires to use said pillow as in a spouse, a child or a visitor. A switching or mixing of different types of shell sections is also contemplated under the present invention as by way of different foam types. In addition to firmness level changes the adjustability of the present invention also makes possible a switching out of different core insert types as in switching a down core insert with a hollow fiber filler core insert.

Also, the comfort level choice versatility make available other options as in the ability to request a comfort level by way of internet ordering on line which gives a hotel or other cushion user facility the ability to better meet the needs of their users (customers)—as in an advance request of a person ordering a room of a hotel over the internet by, for example, mouse clicking or similar option setting means amongst a variety of comfort level options based on switching out core inserts and/or shell section types.

BRIEF DESCRIPTION OF THE FIGURES

FIGS. 11A to 11D illustrate a user core insert choice and installation step sequence;

DETAILED DESCRIPTION OF PREFERRED EMBODIMENTS

Figure 1:
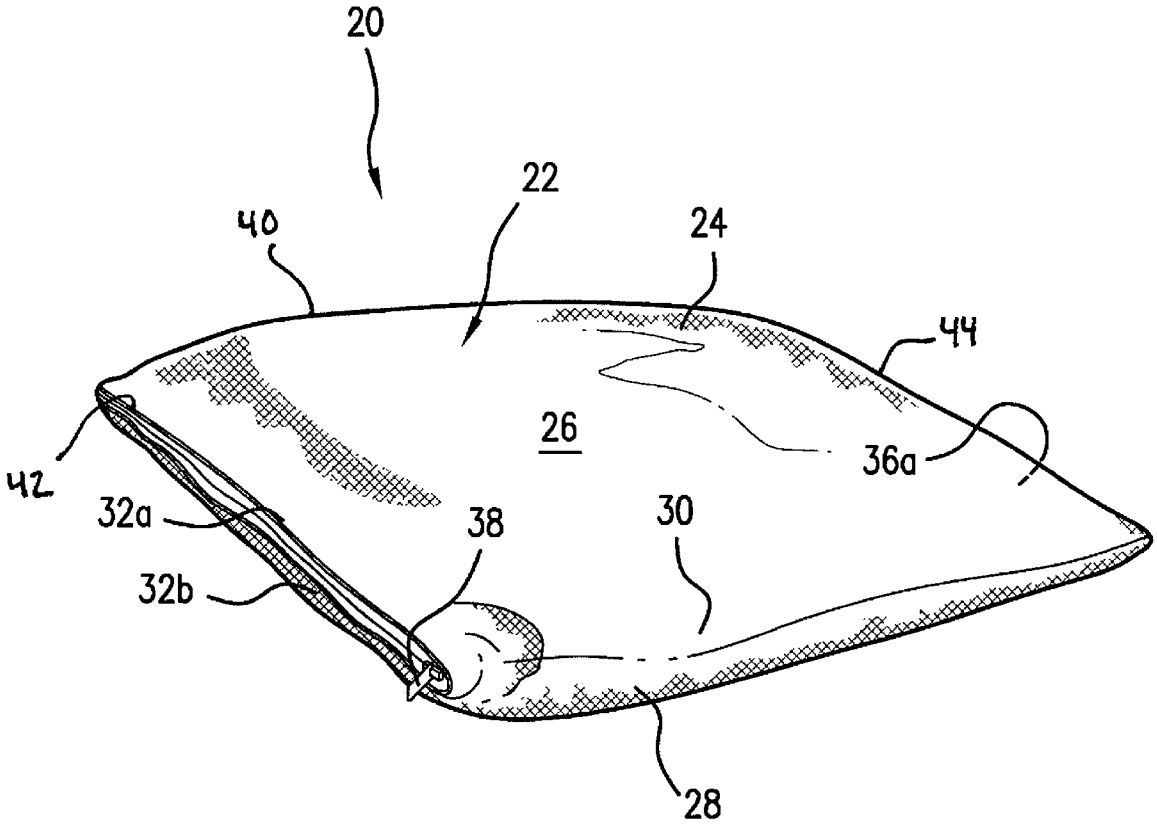
FIG. 1 is a perspective view of a pillow embodiment of the present invention.

FIG. 1 illustrates cushioning device 20 of the present invention which is in the form of a pillow comprising cover 22. Cover 22 is shown as being a cloth cover although a variety of other cover types are contemplated with the cover providing confinement means relative to all cushion components encompassed by the cover as explained in greater detail below. Cover 22 includes exterior layer 24 which, in a preferred embodiment, is a layer of material that provides, in a head pillow embodiment, a pleasant head contact feel (e.g., soft face contact material) as in a "Velour" fabric layer and is of high strength and suitable thickness to withstand direct handling contact. Exterior layer 24 is shown extending fully across the top 26, the bottom 28 and along long intermediate side 30 of pillow 20. With this preferred arrangement, a single sheet of material can define the entire exterior layer of the pillow upon folding the single sheet about an intermediate section 30S (FIG. 2) in hinge like fashion, which intermediate section 30S defines side 30 of pillow 20.

Figure 2:
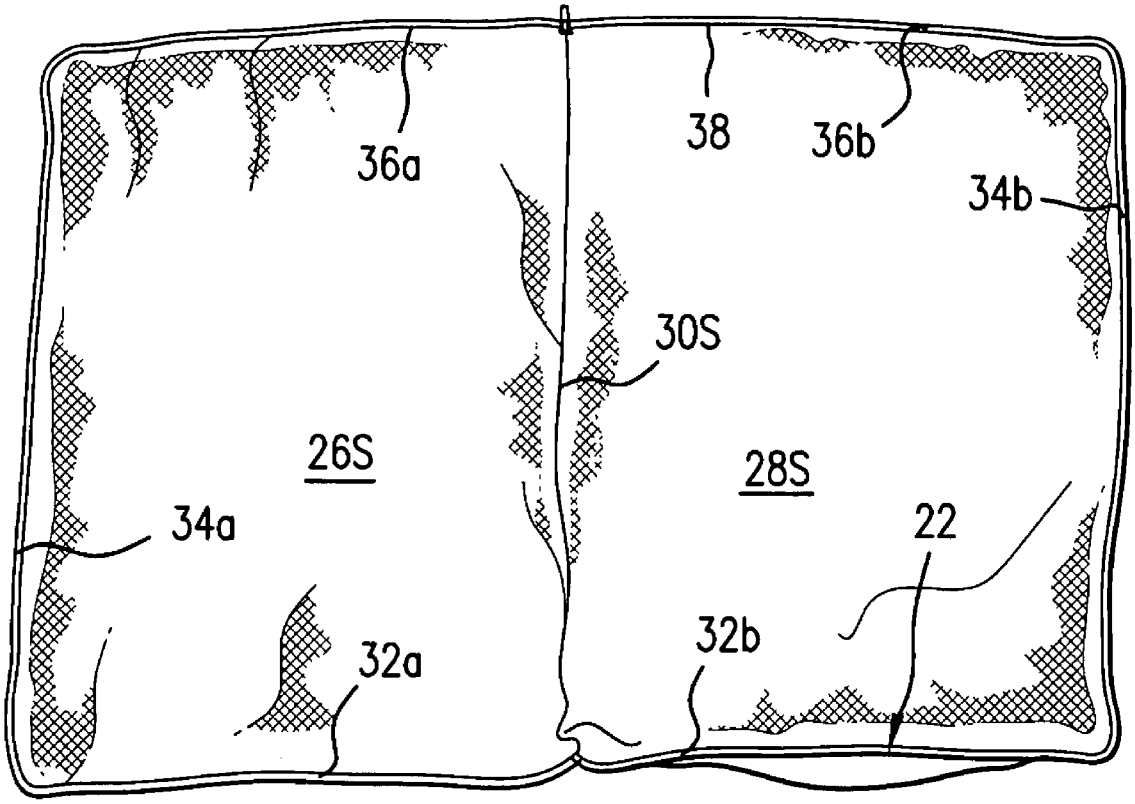
FIG. 2 is a top plan view of the shell assembly of FIG. 1 folded open.
Figure 3:
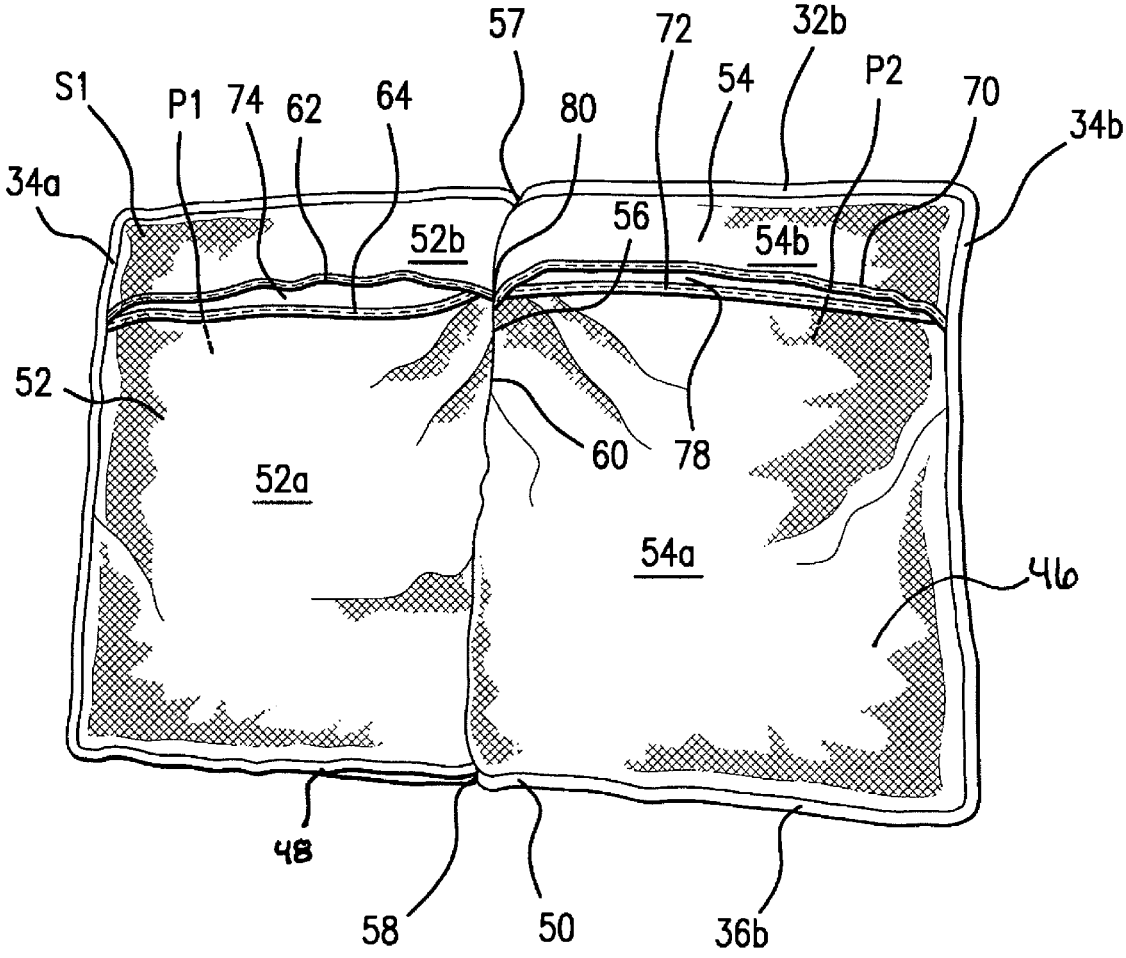
FIG. 3 is a bottom plan view of the shell assembly of FIG. 2.

As shown in FIGS. 1 and 2, free peripheral edges (32*a*, 32*b*, 34*a*, 34*b*, 36*a*, 36*b*) of the folded sections 26S, 28S of exterior layer 24 (with cover sections 26S and 28S representing the top and bottom of pillow 20 when the pillow is in use) are preferably provided with releasable closure means 38 (shown as a zipper assembly, although alternate closure means are also featured as in snaps, buttons, Velcro material, hooks, loops, clasps, etc.). The releasable closure means 38 is designed to maintain, once closed, the interior pillow components confined until a desired release by a user (e.g., a user can be, for example, a person using the pillow for sleeping or a person otherwise handling the pillow as in a hotel cleaning person). With a zipper assembly shown as the closure means 38, the two end points of zipper travel preferably coincide with the opposite ends of intermediate section 30S. Thus, to close cover 22 from the open state shown in FIG. 2, a user folds the opposite cover sections 26S and 28S of cover 22 about the hinge-like intermediate section 30S which is also the cover fold location, such that the peripheral edges are aligned. The zipper can then be run to the opposite end of intermediate section 30S to seal off the interior shell cavity of pillow 22 as shown in FIG. 1. The closure means 38 preferably closes at least one (e.g., a semi-circle shaped pillow), and more preferably multiple sides of the cushioning device 20 (e.g., at least 2 or more, and preferably a majority or more of the sides of the cushioning device). The pillow 20 embodiment shown in FIG. 1 has four sides and thus the closure means preferably is associated with three or four sides of the four sided pillow; with FIG. 3 illustrating a preferred fold arrangement in a three of four side arrangement, and with a four of a four sided pillow (not shown) providing a complete separation of cover sections mode (which is workable under the present invention, but less preferable from the standpoint of separated cover misplacement and greater assemble/breakdown time).

Pillow 20 is shown in FIG. 1 in a preferred configuration, which is a configuration designed to match a typical pillow shape with four sides comprised of two parallel longer sides (30 and 40 in the pillow shown) and two parallel shorter sides 42 and 44 to provide a rectangular configuration and a top and bottom surface which are separated a maximum amount in a central region of the upper and bottom sections 26S and 28S and have exterior surfaces that slope down to the peripheral edging of the pillow when fully assembled. Thus the pillow has an upper convex shaped exterior surface 26S above a horizontal mid-height bisecting plane and a symmetrical lower convex shaped exterior surface 28S below that bisecting plane. With this embodiment the preference is for a single side 30 of pillow 22 to be free of the closure means and to have the remaining three sides inclusive of the closure means such that cover 22 can be opened in notebook fashion about the pillow edge defined by side 30. Also the preference is for the hinge section 30S of cover 22 to extend perpendicular between two of the longer sides of an open cover and, following folding of the cover (for closure means closure), the hinge section 30S preferably represent a longer side of the rectangular pillow 20 illustrated, although an alternate preferred embodiment features one of the end sides of the pillow free of closure means and the remaining three inclusive of the closure means so as to have it fold open about that shorter edge.

FIG. 2 shows cover 22 opened up and with the exterior surfaces 26S and 28S of the exterior layer 24 of the pillow visible and the interior surface generally not being visible. FIG. 3 shows the opposite, with the interior (in use) cover layer 46 of the folded open cover 22 shown, and the exterior layer 24 being hidden from view. FIG. 3 also illustrates the underside of runners 48 and 50 for the zipper closure means 38, which runners are supported on respective peripheries of sections 26S and 28S of exterior layer 24. Interior cover layer 46 is comprised of first interior cover section 52, second interior cover section 54 and intermediate cover section 56 which generally correspond with their exterior section counterparts 26S, 28S and 30S and which preferably have peripheral edging also attached to closure means 38 (e.g., a stitching that connects them to the zipper runners 48 and 50 having runner end points 57 and 58) or directly to the opposite layer with one of the two supporting the runners 48, 50. Interior cover layer 46 is also preferably formed of a light weight covering material such as in a woven, non-woven, knitted, netted, film material, or other covering material which is able to sufficiently retain a (below described) shell section. Since interior cover layer 46 is not subjected to face contact or to as extensive direct user handling contact, it is preferably formed of a different material than that used for providing exterior layer 24 as in a less dense and/or less thick material as in a "stockinet stitch" cotton material being a suitable example.

Also, as explained in greater detail below, interior cover layer 46 preferably has two slots 74 and 78 formed in it which can be provided by attaching two continuous strips S1 and S2 of interior cover material which extend parallel and from short end to short end of cover 22, and with the pockets formed by the peripheral stitched edging and the intermediate joining of intermediate section 30S and 56 preferably also a stitch running between the zipper runner end points as described below). Interior cover layer 46 is thus preferably comprised of strips S1 and S2 (or formed as a continuous sheet with suitable slits formed in it (e.g., cut slits)) to define slots 74 and 78 with the strips (or overall layer sheet) sized to provide a larger overall area relative to exterior layer 24 such that there is a looseness or layer separation potential when the generally common peripheral edging of layers 24 and 46 are fixed relative to each other as via attachment to the intermediate zipper runner material. Intermediate section 54 of interior cover section (a spatial rather than structural reference when single layer sheeting is being used as the cover interior 46) is preferably joined to the exterior layer 24 by attachment means 60, which in a preferred embodiment is a stitch running from one long side to the other long side of cover 22 and which extend across overlapping portions of strips S1 and 22 as represented by reference 80 in FIG. 3. The arrangement of strips S1 and S2 and attachment means 60 thus help to define essentially a single layer for the interior layer with two accessible pockets P1 and P2 formed between the respective sections of exterior layer 24 and interior cover layer 46, which pockets provide shell section receiving means. Examples of alternate forms of attachment means for the intermediate sections of the cover layers comprise an adhesive strip, Velcro stripping, a heat bond (when the cover materials allow), or mechanical means, etc. which helps, together with the exterior fixing of the layers' peripheral edging, to complete the two illustrated pockets P1 and P2.

Figure 4:
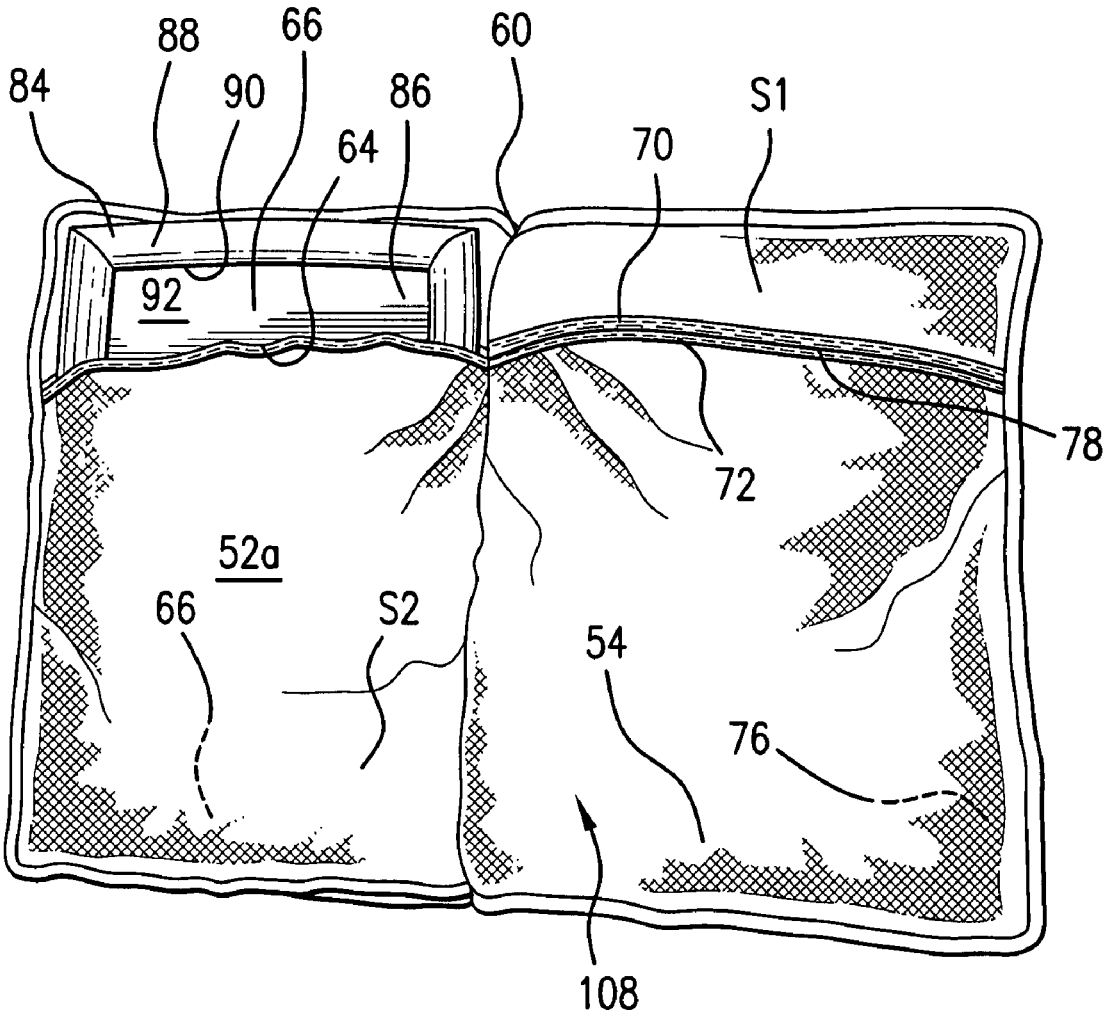
FIG. 4 is a view similar to FIG. 3 but with a shell section partially withdrawn from its pocket or cover receiving area.

As seen from FIGS. 3 and 4, first interior cover section 52 includes upper and lower portions 52A and 52B having juxtaposed edging 62,64 (preferably a slight overlap to close off pockets P1 and P2 as shown in FIG. 4 when shell sections 66, 76 (only 66 shown in FIG. 4) are received in pockets P1 and P2); FIG. 3 is shown as having the shell sections removed showing less taught interior cover layer sections 52 and 54. Edging (62 and 64) is preferably formed by folding over a portion of the adjacent free ends of portions 52*a* and 52*b* of strips S1 and S2, and edges 62 and 64 provide for insertion/removal slot 74. FIG. 4 further illustrates shell section 66 in a state of being initially withdrawn from pocket P1 through slot 74 when being pulled at its exposed end away from pocket P1 (or close to being fully installed within pocket P1 when being directed into the pocket in the opposite direction as by having a user reach into the pocket P1 and pull on the more inserted end to help place the shell section in its final resting position within the pocket, or a sequenced push-pull action to place shell section 66 in position within pocket P1). A similar activity can be used for insertion/removal of shell section 76 relative to pocket P2, as both the shell sections 66, 76 are preferably formed to have the same shape and are of the same material as in both being formed from a common mold design. For added variation the shell sections 66, 76 can be formed differently as in one thicker or higher in vertical height than the other or of different material as in one being less firm than the other. However, from the standpoint of universal manufacture and usage, shell sections 66 and 76 are preferably formed of the same shape, dimensions and material. Further, the arrangement of cover 22 to the left and right of attachment means 60 is preferably symmetrical (both internally and externally). As seen from a comparison of the left side and right side of FIG. 4, the shell sections are slid below the larger length pocket portion (52*a*) and then, once sufficiently inserted, the flexible shell section can be tucked under the other corresponding pocket portion (52*b*) and then the shell section is fully received within the pocket which then seals off the shell section due to the potential for pocket portion overlap at the slot formation edges (72, 78). There can also be provided access opening edge connectors as in having Velcro fastener strip(s) along the overlapping access opening edging, although the filling in of the pockets and the preferred stitching in the strips S1, S2 results in a tendency for the overlapping access opening end regions to close in a flush relationship when drawn somewhat taut.

Figure 7:
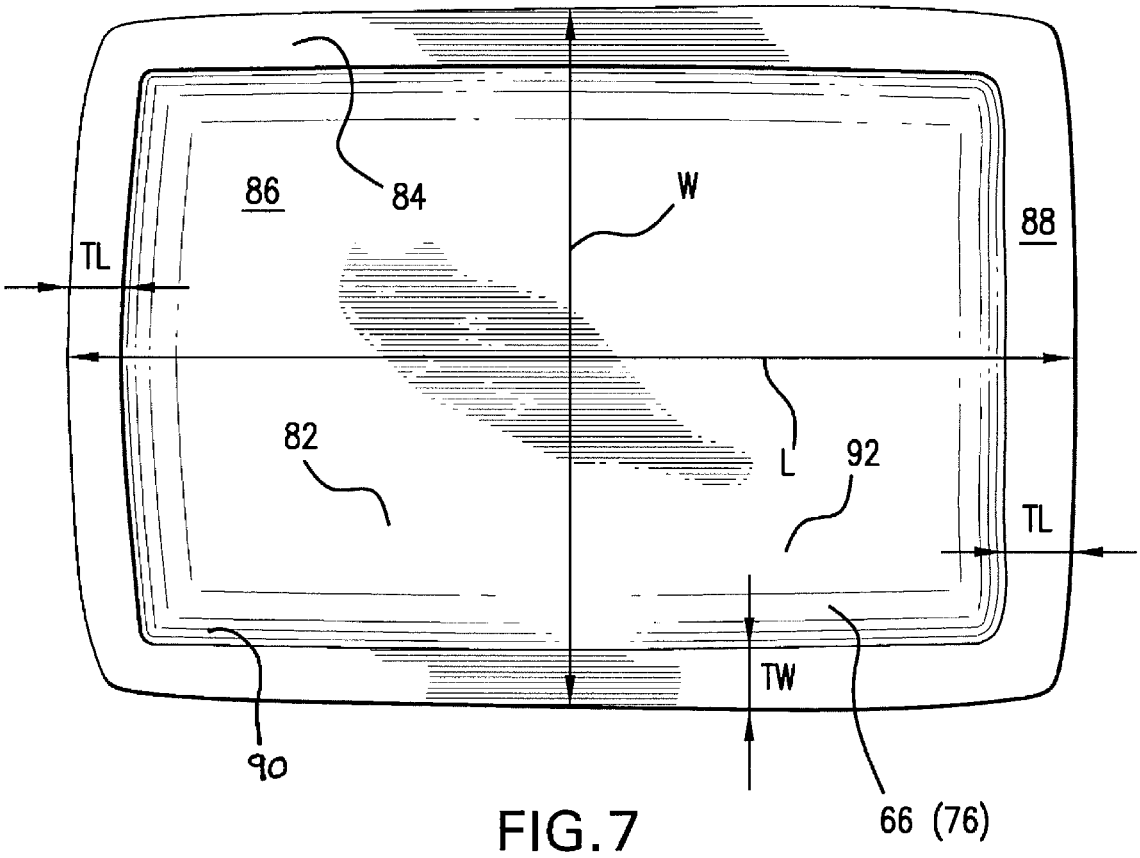
FIG. 7 shows the interior side view of one of the two shell sections that are received by the shell cover and which preferably each have a cavity designed to receive an inner core insert and a rim designed for flush contact with the rim of a second shell section (with the respective intermediate cover layer sections sandwiched therebetween)
Figure 8:
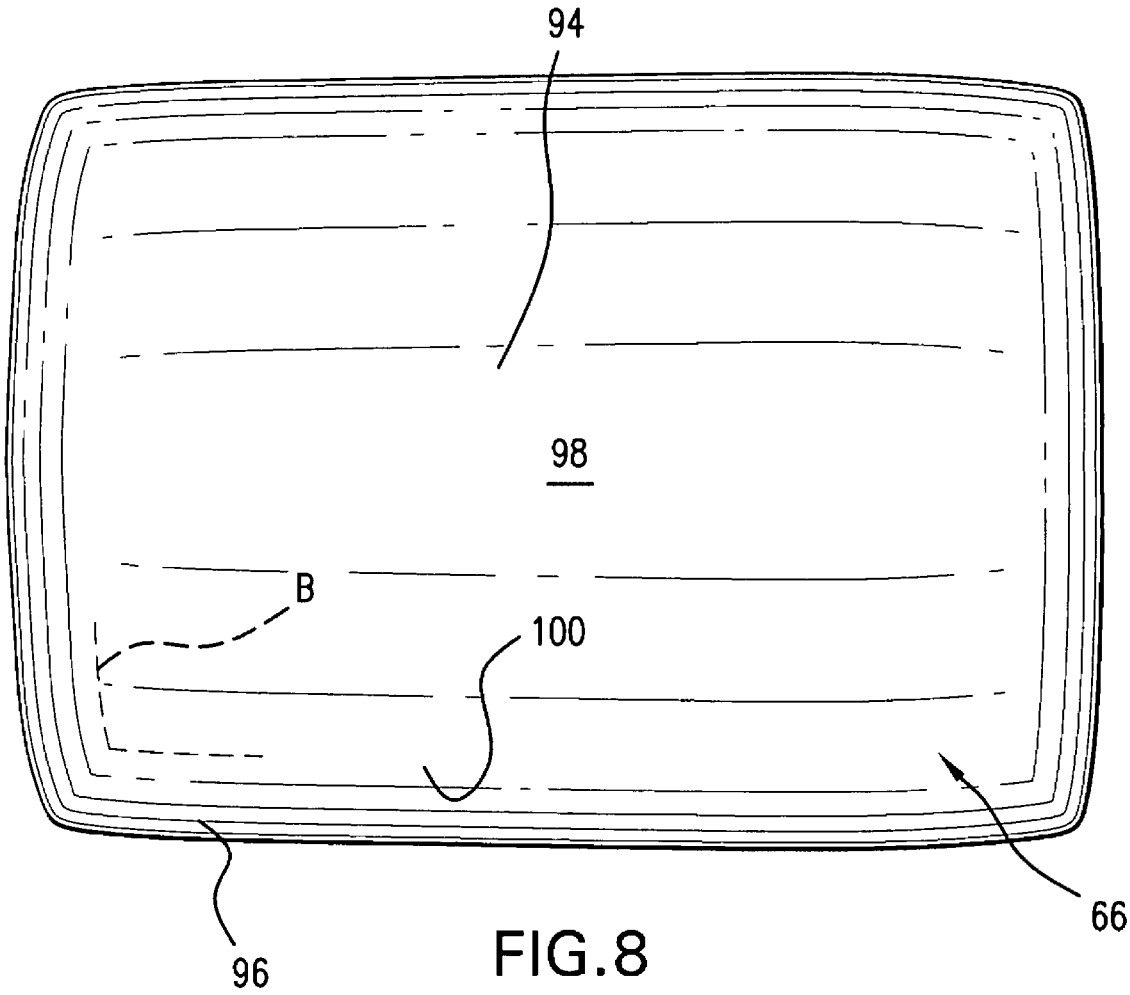
FIG. 8 shows the opposite or exterior (in use) side of the shell section shown in FIG. 7.

With reference to FIGS. 4, 7 and 8 there is provided a discussion of shell section 66 (which discussion is generally applicable to the second shell section in a preferred embodiment and thus in FIG. 7 shell section 76 is referenced together with shell section 66). Shell section 66 is preferably formed as a foam body as in a unitary or integrated (e.g. monolithic, laminated or interconnected) body and more preferably as a solid, monolithic, unitary material foam body, with the preferred foam types including visco-elastic foam, "conventional" polyurethane foams and high-resiliency polyurethane foams.

The foam utilized for the shell sections is designed to provide a high degree of comfort while still achieving the desired level of support at the desired height elevation off the underlying supporting surface (e.g. a couch frame, box spring, or bed or floor). To facilitate a discussion of the preferred characteristics of the foam material of the present invention, reference is made to the following preferred summaries of some quantitative values associated with foam material.

Indentation Force Deflection (IFD)—A measure of the load bearing capacity of flexible polyurethane foam. IFD is generally measured as the force (in pounds) required to compress a 50 square inch circular indentor foot into a 4 inch thick sample, typically 15 inches square or larger, to a stated percentage of the sample's initial height. Common IFD values are generated at 25 and 65 percent of initial height. (Reference Test Method ASTM D3574). Note: Previously called "ILD (Indentation Load Deflection)".

Compression Modulus—This is generally referred to as representing the ratio of a foam's ability to support force at different indentation (or compression) levels. It is determined by taking the ratio of the foam's IFD at 25% indentation and 65% indentation (65% IFD/25%). The compression modulus is typically a function of foam chemical formulation and the manufacturing process. In most cases, the higher the density the greater the compression modulus. Other terms that are used interchangeably are: support factor, and modulus.

Density—A measurement of the mass per unit volume. It is measured and expressed in pounds per cubic foot (pcf) or kilograms per cubic meter (kg/m$^3$) (Test Method ASTM D3547).

High Resilience (HR) Foam—A variety of polyurethane foam produced using a blend of polymer or graft polyols. High resilience foam has a less uniform (more random) cell structure different from conventional products. The different cell structure helps add support, comfort, and resilience or bounce. High resilience foams have a high support factor and greater surface resilience than conventional foams and are defined in ASTM D3770.

Hysteresis—The ability of foam to maintain original support characteristics after flexing. Hysteresis is the percent of 25% IFD loss measured as a compression tester returns to the normal (25% IFD) position after measuring 65% compression. Lower hysteresis values, or less IFD loss are desirable. Current research indicates that hysteresis values may provide a good indication of overall flexible foam durability. Low hysteresis in conventional foam is equal to less IFD loss.

Laminating—The bonding of layers of foam and/or other materials together into a single composite. This may be accomplished through adhesives or through heat processes like flame lamination.

Support Factor (see Compression Modulus)—represent 65% IFD/25% IFD determined after one minute of rest or recovery. When the support factor is known it can be used in conjunction with a known 25% IFD value to determine the 65% IFD value. Foams with low support factor are more likely to bottom out under load.

In a preferred embodiment the foam material utilized for each of the shell sections is visco-elastic foam. Suitable visco-elastic foam is available from Carpenter Co. of Richmond, Va. under the trademark VISCOLUX® foam and CONFORM® foam as well as high density visco-elastic foam material number 2045432 which is well suited for molding. Visco-elastic foam is typically classified as a high density, visco-elastic, open-cell material. The open-cells are generally spherical with windows and are temperature and weight sensitive (becoming softer upon being heated such as by body heat). When a visco-elastic material is utilized as a shell section of the present invention, the preferred density range is 3.0 to 7.0 PCF more preferably 4.0 to 6.0 PCF, with 5.0 PCF being preferred in the illustrated embodiment. A 25% IFD value of from 7.0 to 13.0 lb compression at 20° C. represents a preferred hardness range with 10 lb being a preferred value for the illustrated embodiment. For pillows, a 25% compression value is most informative due to the typical compression force asserted by a user's head.

Visco-elastic material is a preferred material relative to the combination of materials featured in the present invention as it provides a highly conforming foam that assumes the contour of whatever object is compressed into the material and retains it while the compressive force is in effect and even for a brief time period following release of the compression. This ability to directly conform to the contouring of a compressive body provides a high level of low pressure support as all points or essentially all points of possible contact find foam support. The fact that the foam material softens with body heat also means that the higher compression areas will tend to heat up the most, and correspondingly soften the most applicable pressure points. Other cushion materials can be utilized for shell section 66 including "conventional" and "high resiliency" polyurethane foams that also, when achievable, are preferably provided in the above noted visco-elastic foam density and IFD ranges and values. Suitable "conventional" densified polyurethane foam includes OMALAN® and HYPERSOFT® foam products of Carpenter Co. and a suitable high-resiliency foam includes QUALATEX® foam of Carpenter Co.

Figure 13:
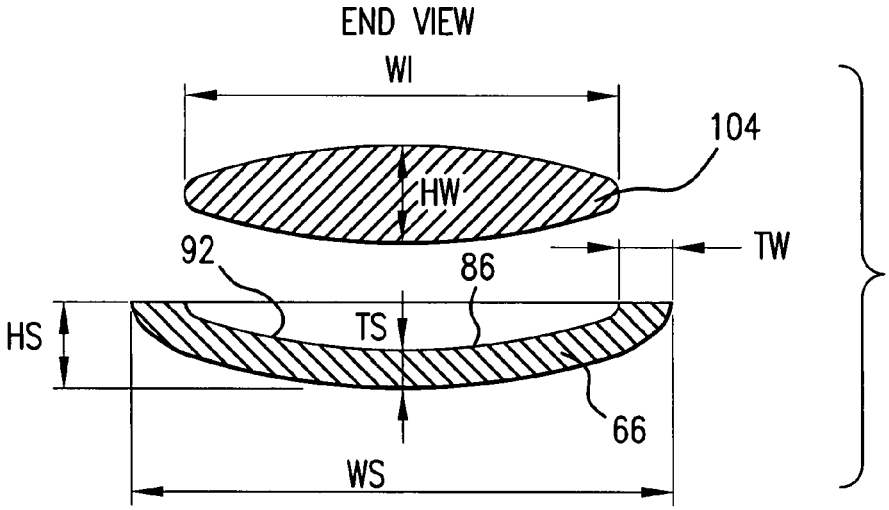
FIG. 13 illustrates a schematic (end view section extending across pillow width) cross-sectional depiction of the inner core insert and one shell section interrelationship like that shown in FIG. 9 but with the core insert elevated.
Figure 14:
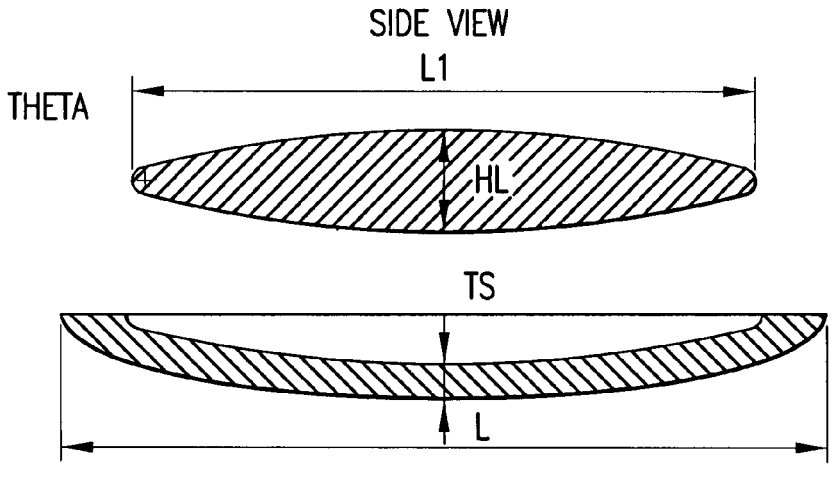
FIG. 14 illustrates a schematic (side view section extending across the pillow length) cross-sectional depiction of the inner core insert and one shell section interrelationship like that shown in FIG. 9 but with the core insert elevated.

FIG. 7 shows the interior (in use) side 82 of shell section 66 which includes rim 84 and recessed region 86. Rim 84 preferably has an exposed, continuous, generally planar surface 88 which matches the rectangular periphery of the illustrated preferred rectangular embodiment for shell section 66 and, when stacked on the corresponding shell section 76 (see FIG. 15 for a schematic presentation of that stacking arrangement wherein shell sections 66 and 76 are stacked to complete the formation of a pillow shell 67) can provide a sealed shell arrangement with the preferably thin (e.g., "stockinet" cotton sheet) material of interior cover layer 46 for each of sections 52 and 54 being sandwiched between the facing rims 84 when the pillow is assembled. As further seen in FIG. 7 (and also FIGS. 9 and 10) recessed region 86 of shell section 66 includes a floor section 92 which is preferably generally planar (particularly when supported from below by a flat surface) although a continuous concave configuration as shown schematically in FIGS. 13 and 14 is also featured under the present invention which tends to relax when supported as a flat surface as show in FIG. 7. Floor section 92 is further shown in FIG. 7 to have a sloping (e.g., straight line or curved as in a concave surface) bridging shell region 90 that extends around the shell section together with rim 84. A depth of 0.25 to 0.75 of an inch is illustrative as the depth of floor section 92 relative to the interior edge of rim 84, when the overall height is about 2 to 3 (e.g., 2½ inches) and the base floor thickness is about 0.5 to 2.0 inches with 1.0 being preferred.

FIG. 8 illustrates the exterior (in use) surface 94 of shell section 66 which is placed in contact with the interior side of exterior cover layer 24 when cover 22 has received shell section 66 in pocket P1 with the peripheral edging of pocket P1 preferably essentially corresponding with that of the external rim edge 96 of shell section 66. FIG. 8 also shows exterior surface 94 having a generally planar portion 98 (the boundary of which is partially represented by dashed border line B) and upwardly extending curved portion 100 which extends from the border region B to exterior rim edge 96 and helps in defining the lower half of the convex exterior siding of pillow 22 (as featured in FIG. 1 by, for example, side 30). Shell 76, when in its stacking arrangement thus completes the interior body of shell 67 (FIG. 15) that defines the overall pillow shape as cover 22 is positioned about shell 67.

Figure 9:
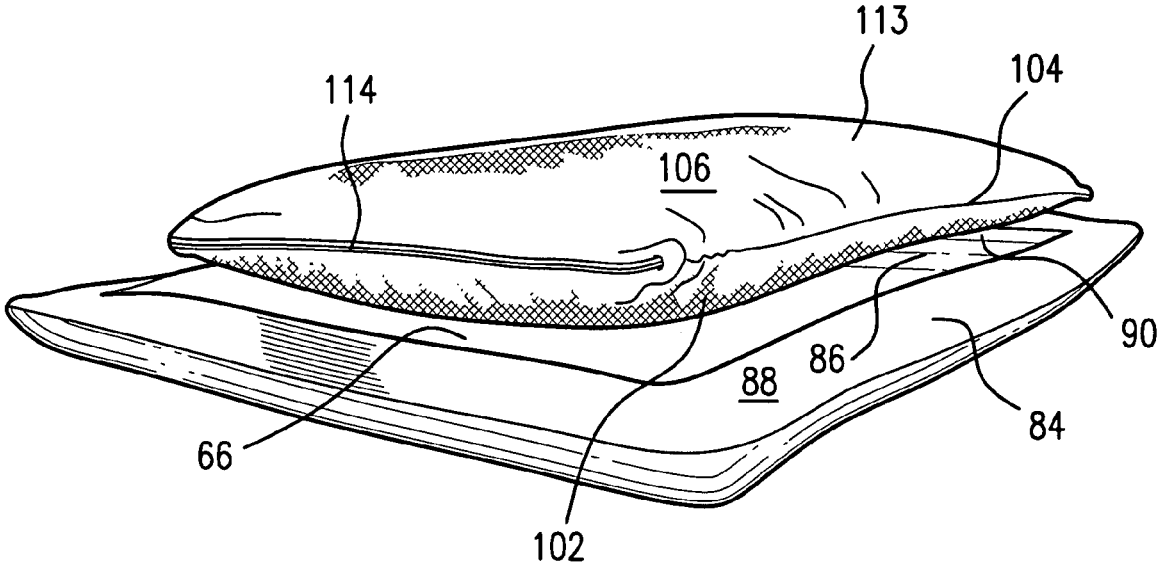
FIG. 9 shows an illustration of the inner core insert received within the reception area of a shell section (each in an uncompressed state) and with the shell assembly cover removed for added clarity of the relationship.
Figure 10:
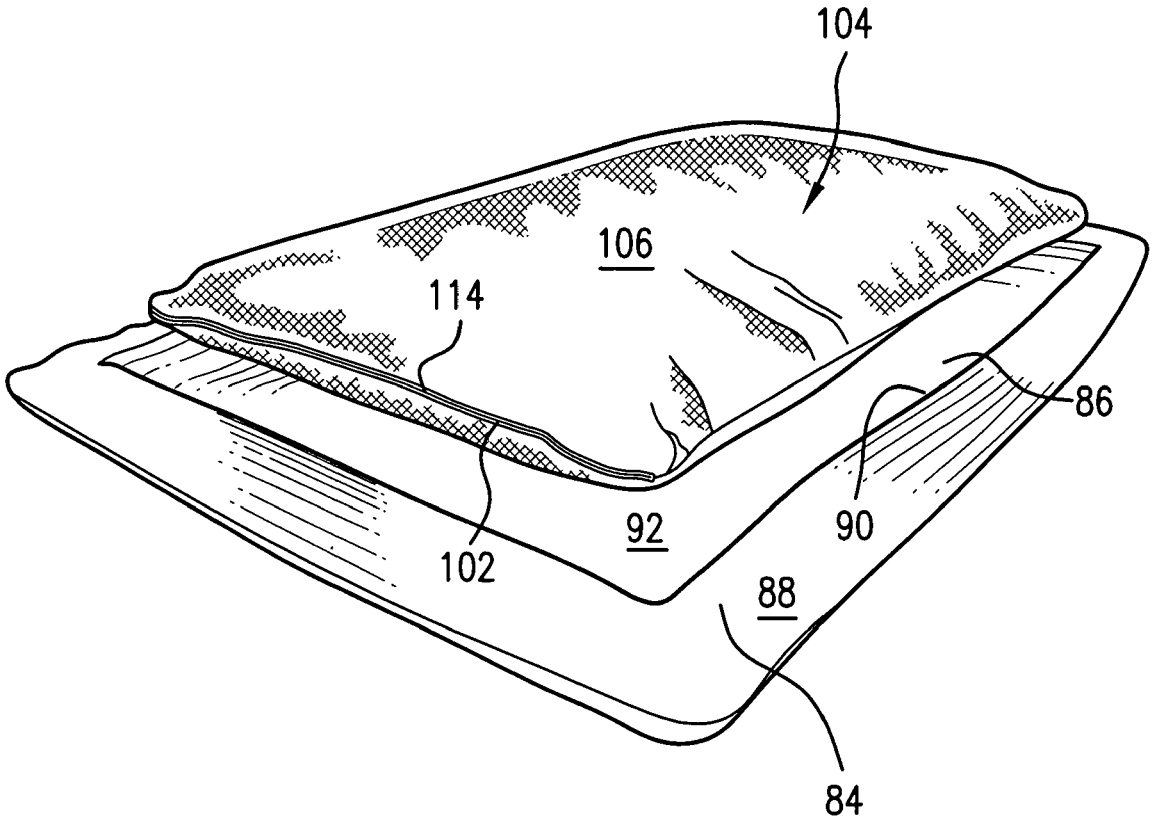
FIG. 10 provides a closer, more upper view of that which is shown in FIG. 9.
Figure 15:
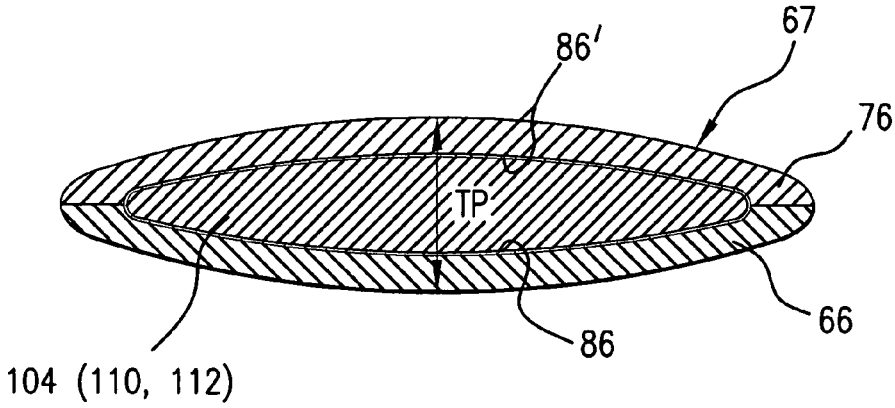
FIG. 15 illustrates a schematic view of the shell stack with the inner core insert received by the sealing upper and lower shell sections (again the cover material being removed for added clarity)

With reference to FIGS. 7, 9 and 10 there is illustrated the nesting relationship assumed by the bottom region 102 of core insert 104 when supported by recessed region 86 of shell section 66. As seen from FIG. 15, a similar nesting relationship is achieved relative to the recessed region of shell section 76 relative to the upper region 106 of core insert 104 when shell section 76 is placed over the core and the rims come into flush contact so as to encompass core insert 104 in its entirety within shell cavity 106 as shown in FIG. 15 although the material of cover 22 would also be sandwiched in between as well (but the cover is not shown in FIG. 15 as the cover is removed for greater clarity of the shell sections' and insert's nesting relationship). The core insert's dimensions are designed to fit within the boundary defined by recess region 86 (e.g., more than 80% of the area represented by the interior edge of rim 84 is occupied by the peripheral area of the core insert and more preferably 90% or greater as in 95% or more). The percentage of occupation values are generally the same for the peripheral area of a core insert relative to the peripheral area of the overall pillow. This relationship, plus the sloping interior wall of rim 84 for each shell section, allows the core insert to fill in the shell cavity upon compression and be fixed in position by the combination of the shell sections, cover and closure means 38. Thus, in a preferred embodiment the core insert 104 is designed so as to contact and be generally held in position by the peripheral holding region provided by the interior of the stacked rims, particularly upon compression in use. The interior cover layer 46 is sufficiently loose to allow for the conformance of the shell sections and the core insert so that they are placed in retention contact as seen in FIG. 15 within "shell" 87.

Figure 5:
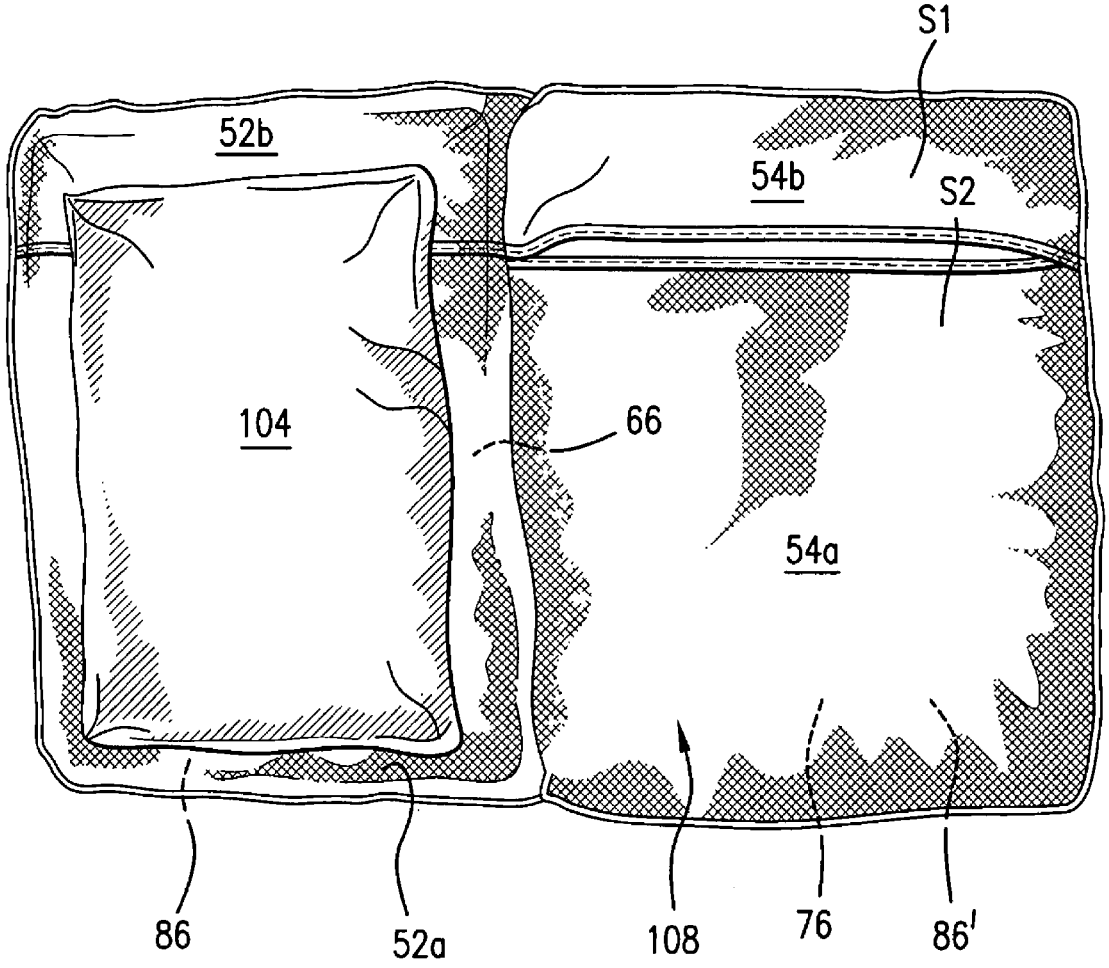
FIG. 5 is a view similar to FIG. 3 with the inclusion of a covered inner core insert resting in position within a recess provided by the underlying shell section.
Figure 6:
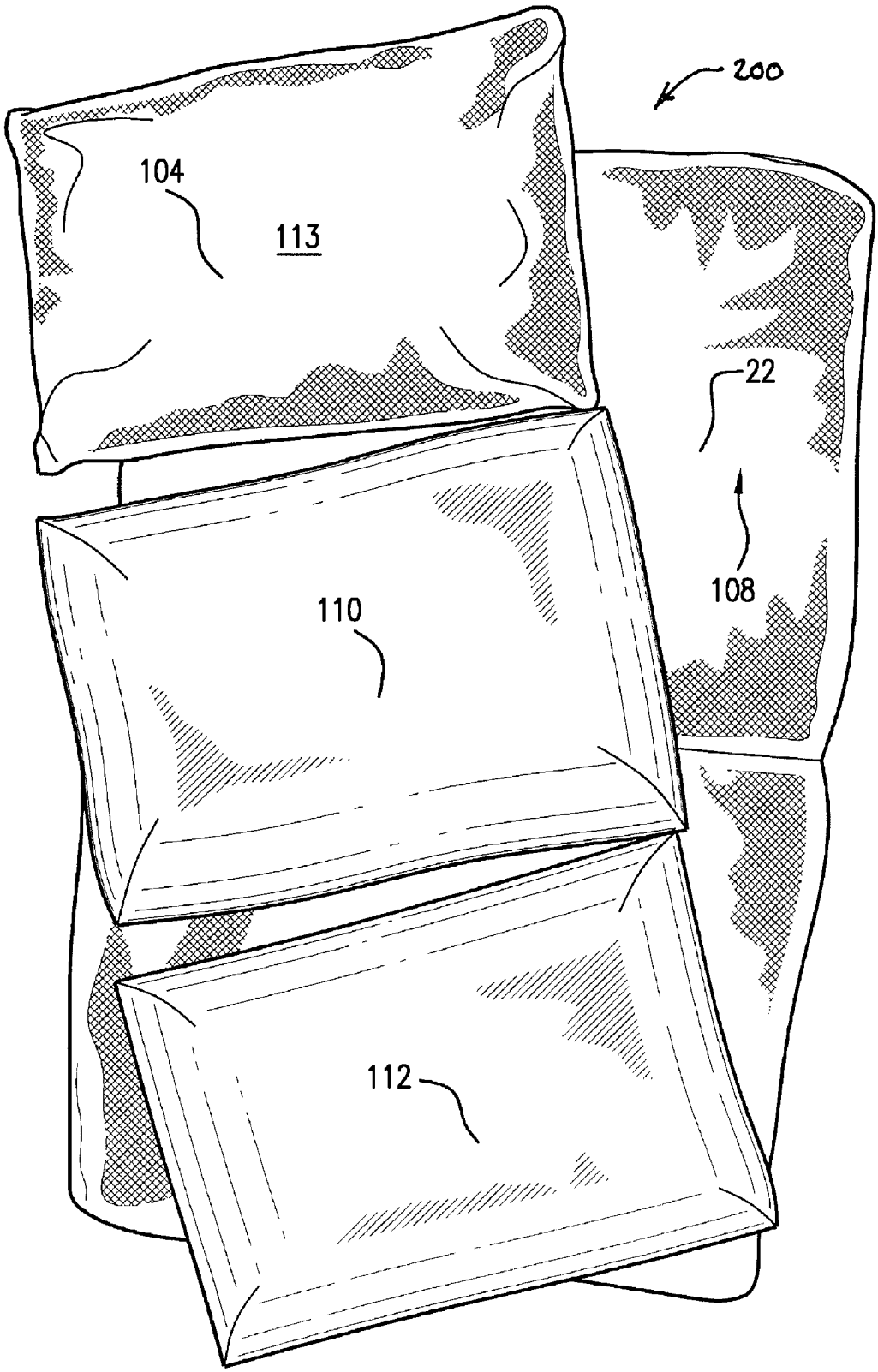
FIG. 6 is a view of the open shell assembly's interior with three optional inner core insert choices illustrated to show the option of choosing one of a multiple inner core insert choices for insertion as shown in FIG. 5.

The configuration and arrangement of cover 22 and shell inserts 66, 76 makes cushion 20 readily adjustable in overall comfort level by providing for ready insertion and removal of different insert types such as the first insert 104 described above. That is, in the embodiment illustrated there is a readily releasable closure means 38 that allows for the opening up of cover 22 to gain access to the two mirror imaged recessed regions 86, 86' of shell sections 66,76, respectively. FIG. 5 illustrates cover 22 having been opened for receipt of insert core 104 which is further shown resting within recess 86 of shell section 66 in similar fashion to FIGS. 8 and 9 but with the cover 22 included. The combination of cover 22 and the inserted shell sections 66 and 76 thus provides shell assembly 108 which can be opened and closed to receive or remove core insert 104. Also, although core insert 104 is shown inserted into shell section 66 (with first interior cover section 52 sandwiched therebetween), such that the cover section 54 is rotated on top of core insert 104 during pillow assembly, core insert 104 can also be placed in recess 86' of shell section 76 (with cover section 54 sandwiched therebetween) such that first interior cover section 52 is rotated on top of core insert 104. An alternate arrangement features just one recessed shell section and a planar interior surface of a second shell section With the present invention a user can customize pillow 20 to meet personal comfort criteria (e.g., a low firmness level, an intermediate firmness level or a high firmness level as in different types of foam material and/or variations in material—switching out a down core insert with a fiber insert or an air bladder switch out with a water bladder or gel bladder, etc.) by way of switching out one core insert with another. In this regard, reference is made to FIG. 6 showing an example of having pillow 20 inclusive of a set of different type cores which are sold to a customer to provide pillow kit 200 (or cushion kit depending on usage). In FIG. 6 a set of three core inserts is provided although the number of core inserts in the kit can be increased or decreased to provide lesser (e.g., two inserts) or greater (e.g. three or more as in 3 to 5 core insert) options. In a preferred embodiment shown in FIG. 6 there are three inserts (first core insert 104, second core insert 110 and third core insert 112) which are each different in comfort characteristic.

As seen from FIGS. 9 and 10, first core insert 104 has a cover casing 113 which preferably is a thinner, less expensive version of the outer cover layer 24 material, although intermediate (relative to thickness) interior cover layer 46 (e.g. a cotton cloth casing). Also, core insert 104 preferably includes a closure device as in the illustrated zipper 114. Cover casing 113 thus protects the interior of core insert 104 as it will be handled to some extent during the switching out of a different type of core insert amongst those purchased by a customer. It is preferred to provide kit 200 as a single packaged combination containing shell assembly 108 with a set of core inserts such as those described above and below. The present invention also is inclusive of a method of providing the kit 200 to the customer by having the customer purchase separately a shell assembly and then select from a greater variety of core insert options the one or more (a set of core inserts) desired to go with that shell assembly. Examples of this latter method for providing customers with a kit, includes providing a customer an order choice or choices upon initial sale (e.g., a customer internet mouse click among a plurality of options wherein one or more inserts are chosen which are felt best to accommodate the comfort criteria of a user or a plurality of users, as in family members different criteria, "or in-store" options wherein a customer purchases a shell assembly and then chooses from a plurality of core inserts made available at the same location as in a bin assortment of core inserts). Along these lines, since the shell sections are readily insertable and removable, a plurality of different types of shell sections can also be provided under the subject matter of the present invention in the pillow kit (e.g., a kit with a single core insert and options as to the shell sections or a kit with options on both the core insert and shell sections including individual shell sections of different types (providing a different upper and lower feel) within the same kit or different type pairs of shell section types as in different shell section foam types (material, density, etc)).

In kit 200 of FIG. 6, core inserts 110 and 112 are shown as solid foam bodies (monolithic or laminated, etc) without a cover for added visibility as, while core inserts without covers are featured under the present invention, a preference is to have each core insert with a cover like that for core insert 104 described above. This is based on the user handling associated with the switch out options provided by the core insert set. Also, while the core inserts of the kit can be shaped differently or sized differently, a preference is to have each core insert of the same shape and size which provides the benefit of close conformance in the core's final nesting arrangement once the shell assembly 108 is closed up around the core insert.

In the FIG. 6 embodiment each of the core inserts are solid foam bodies with an outer (accessible) cover with each foam body having a different comfort characteristic. In a preferred embodiment core insert 104 is a visco-elastic foam body which preferably has a different comfort characteristic than shell sections 66 and 76 including when the shell sections are formed of visco-elastic material as well. For example, in a preferred embodiment core insert 104 has a less firm or softer support characteristic than the other two core inserts, and core insert 110 has an intermediate firmness value while core insert 112 has the highest firmness value of the three. This firmness variation can be represented by the different IFD values for each. For example, core insert 104 preferably has a 25% IFD value "X" of from, for example, 5 to 10 with 8 LB IFD being well suited for the purposes of a bed pillow under the inventive subject matter (which X value is preferably less than that of the shell sections as in the shell sections having 10 LB IFD); core insert 110 preferably has a 25% IFD value "Y" of from, for example, 8 to 14 with 12 LB IFD being suitable; and core insert 112 preferably has a 25% IFD value "Z" of from, for example, 12 to 20 with 15 LB IFD being suitable. Thus, a preferred IFD relationship for core inserts 104, 110 and 112 is X<Y<Z relative to IFD values. Also Y and Z are preferably higher than the IFD of the shell sections 66 and 76 with X preferably being less than that of the shell sections.

The density values can also be variable amongst the core inserts 104, 110 and 112 as in core insert 104 having a density value D1 of, for example, 4 to 6 pounds per cubic foot or "PCF" with 5.0 PCF being well suited for the purposes of a bed pillow under the inventive subject matter; and with core insert 110 having density D2 of, for example, 2 to 5 pounds PCF with 2.5 PCF being preferred for a bed pillow of the present invention and with core insert 112 having a density value D3 of 1.5 to 3.0 PCF with 2.25 PCF being preferred for a bed pillow of the present invention. Thus, a preferred density relationship for core inserts 104, 110 and 112 is D3<D2<D1 relative to density values. Also, D1 preferably is equal to the density of the outer shell sections while D2 and D3 are less than the density value of the shell sections. Examples of suitable foam material for the three foam insert cores 104, 110 and 112 include a high density visco-elastic foam as described above for the shell sections 104 and 110 of different IFD and density values and with core insert 112 being of a high resiliency or "HR" foam material as in QUALATEX® foam also of Carpenter Co.

Core inserts 104, 110 and 112 are preferably formed of a unitary or integrated (e.g. monolithic, laminated or interconnected) foam body which can have planar top, bottom and side surfaces, but is more preferably non-planar with convex top and bottom smooth surfaces to provide a core that generally coincides with the overall typical pillow shape like that shown in FIG. 1.

The different core insert types thus provide core adjustment means to pillow 20 to provide a pillow or cushion kit 200, and as described above there is preferably provided three different firmness levels by those core inserts. Also, while the preferred embodiment features having the core inserts all formed as integrated core bodies with examples of integrated core bodies including a fluid filled body such as an air cushion, or more viscous gel core cushion or a foam body, preferably, core inserts 104, 110 and 112 are formed each as a molded body of a compressible foam material such as a polyurethane foam, synthetic or natural foam rubbers, or combinations (e.g. laminated layers) of these materials, etc. Preferred foams include visco-elastic foam, "conventional" polyurethane foams and high-resiliency polyurethane foams. Amongst the integrated foam body options, foam bodies are preferred with those foam bodies preferably being solid foam bodies (no cavities formed other than those of the foam material itself) although core inserts with unfilled or filled added cavities are also featured under the present invention. Also the foam bodies are preferably provided with individual covers.

The present invention also features alternate core insert types as in a combination of foam and non-foam core inserts or all non-foam core inserts. Examples of alternate forms of core adjustment means includes a core insert set comprising core inserts with individual filler elements as core fillers (e.g., non-unitary or non-integral filler material which can be formed of a large number of separable or independent components such as down feathers and staple fibers, foam particles, etc) for providing the cores with the different firmness levels based on either different density packing and/or different type filler material as in ground up foam as one filler material for a first core insert and fibers as another filler material for a second core insert and down as a third type core insert example. Filler materials that are suited for use of the present invention include synthetic "staple fiber" including polyester fiberfill (e.g. polyethylene terephthalate staple (i.e. cut)) fibers that are preferably slickened (e.g. coated with silicones or polyethylene terephthalate/polyether segmented copolymers to reduce friction and clumping). Additional examples of cores made of different polyester fiber types include cores made of a cluster of fiber-balls or conjugated or staple fibers, hollow fibers and the like as filler means for one or more of the core inserts providing comfort level adjustment means or mixtures of foam and filler as in core inserts with Conjugate, Hollow Fibers and Cluster fibers "#6", respectively (it being noted that while the core inserts are generally described above as having one or the other type filler means as the means for comfort level adjustment, the present invention also includes mixtures of the different types of filler material as well as hybrid arrangements as in core inserts being formed of combinations of a foam body with filler material within the and/or external to the foam body as in a side-by-side foam body/filler relationship).

Visco-elastic usage as a material for shell sections and one or more of the core inserts (e.g., 104 and 110 at different densities) provides a highly comfortable pillow as visco-elastic foam assumes the form in a somewhat "reluctant" manner of the shape of the body being supported by the visco-elastic foam and thus the combination of features in pillow 20 promotes natural neck and shoulder alignment in use. After assuming the form of the body, the visco-elastic foam returns in a correspondingly "reluctant" manner to its original form when the pressure from the body is removed. A general definition of a visco-elastic foam may be ascertained from the following scenario: A rigid object, such as a steel ball, is dropped vertically downwards from a height of 1 m onto a plane surface of the visco-elastic foam resulting in an upward rebound of the rigid object of less than 10%, i.e., a rebound of less than 10 cm upwards from the plane surface of the visco-elastic foam. The visco-elastic foam thus exercises only a modest elastic counter-pressure against that surface by which it is loaded, and for precisely this reason it will therefore allow the body to sink relatively deeply into the cushion in such a manner to distribute its overall counter-pressure over a large area of the body, with a relatively uniform and relatively low counter-pressure per unit area of the supported area of the body.

When the cushion of the present invention is utilized in other settings as in a futon mattress, dog bed, etc, the shell sections and core insert(s) are designed to present a configuration similar to the typical cushion design used typically in that cushion setting, only the comfort level can be personalized to suit an individuals comfort level criteria (inclusive of animals which could be suitable for a change in weight of the animal user, etc).

FIGS. 11A to 11D provide an illustration of a user assembling pillow 20 of the present invention. As seen in FIGS. 11A to 11D, at step S1 user 126 has opened up shell assembly 108 by adjusting closure means 38 to an open position. At step S2, user 126 decides which core insert amongst a set of core inserts 104, 110 and 112 is desired for use at that time, with core insert 112 shown to have been selected. In step S3 the user is shown as inserting selected core insert 112 into the recessed region 86' of the shell section 76 covered over by cover section 54. Step S4 shows pillow 20 in a state where closure means 38 has been closed back up to complete pillow formation and the user is utilizing pillow 20 with the desired core insert 112. This sequence can be later repeated except with either the same or a different user choosing a different comfort level by choosing a different core insert amongst those presented in the set shown.

Figure 12:
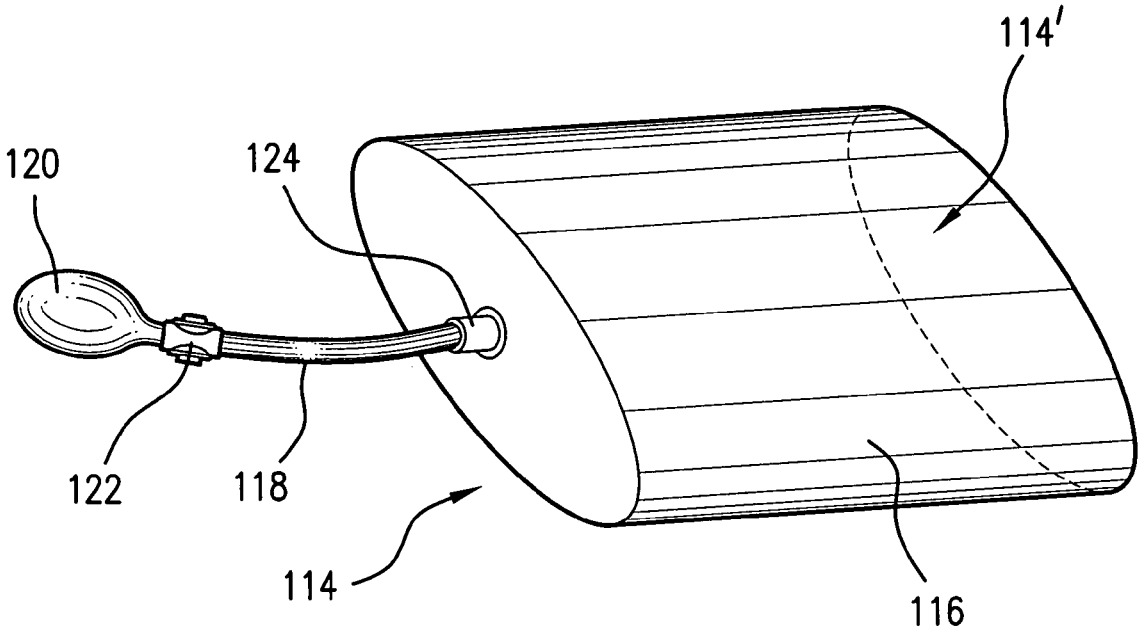
FIG. 12 illustrates an alternate inner core insert embodiment comprising an air bladder core with pressure adjustment device.

FIG. 12 illustrates an example of air bladder core insert 114. In the embodiment shown, air bladder core insert 114 comprises main body 116 (sealing fluid container) and inflator mechanism 118. Inflator mechanism is further shown to include a pump ball 120, release valve 122 and bladder bag valve connection 124 which can either be permanently attached to the main body (with the remainder of the pillow having a cavity for accommodating it) or detachable. The inflator mechanism thus allows some degree of firmness level adjustment in the core in and of itself (which can avoid the need for addition core inserts in some instances or can provide an added adjustment range relative to a set of core inserts). However, this embodiment is less preferable than the multiple insert core adjustment means free of an adjusting air bladder insert, as air bladder embodiments like this are prone to seal leaks and firmness level adjustment is just one of a variety of variables going into how a user perceives the "feel" or part of the comfort level of the pillow. Thus, while an inflation adjustable air bladder core insert that is suited in shape for insertion between the shell assembly 108 represents an alternate embodiment of the present invention (either used alone or as one of a variety of core inserts), it is, however, considered less desirable than the different type core inserts of a non-air bladder type that can be switched out for varying the comfort level to accommodate the tastes of a user. Also, due to the complexity added with an inflator mechanism and associated valve, an air bladder embodiment free of such an inflator mechanism device (or one that is detachable) is an alternate embodiment of the present invention. A completely sealed air bladder free of any form of air inflator or potential for inflation adjustment represents a less complex device that would more readily fit within shell assembly 108 and thus avoids some of the above noted limitations and therefore can provide an alternate core insert option under some embodiments of the present invention.

FIG. 13 provides a schematic presentation of a combination of shell sections and core insert in exploded view fashion to illustrate a preferred general dimensional relationship. The FIG. 13 embodiment presents a bed pillow configuration that is designed to be similar in shape, length, width and height as a conventional head pillow. As noted above, the present invention is inclusive, however, of a variety of different types of cushion types and shapes (e.g., a body pillow with two canoe-like shaped shell sections and a cylindrical insert core, etc.). A bed pillow configuration like that shown in FIG. 13, can also come in a variety of sizes in addition to the typical 16 inch width, 22 inch length and 5 inch maximum height in the center shown in FIG. 1. For example, in FIG. 13 there is illustrated core insert 104 in cross-sectional end view showing a maximum central height of HW with 1.5 to 6 inches being preferred and with 2.8 inches being well suited for achieving the "typical" pillow size noted above. FIG. 13 shows insert 104 also having a convex upper and lower shaped surface relative to a central horizontal bisect as well as width WI with 9.0 to 16.0 inches being preferred and with 12.8 inches being well suited for achieving the "typical" pillow size noted above. In FIG. 13 there is further illustrated shell section 66 (76) in cross-sectional end view showing a thickness TS below surface 92 of recessed section 86 with 0.5 to 3.0 inches being preferred and with one inch being well suited for achieving the "typical" pillow size noted above. FIG. 13 shows rim 84 having a thickness across the planar surface TW with 0.5 to 3.0 inches being preferred and with 1.5 inches being well suited for achieving the "typical" pillow size noted above. A shell section height HS is preferably 1.5 to 4.0 inches with 2.5 inches being well suited for achieving the "typical" pillow size noted above. Examples of additional less standard pillow designs include a "petite" pillow with a 4 inch maximum height (and suitable reduction in the shell section dimensions and core insert to achieve the petite size or an "enlarged size pillow with 6 inch maximum pillow height with suitable shell sectional insert core size expansion(s).

FIG. 14 shows the same relationship as shown in FIG. 13 but from a longitudinal or length cross sectional through the shell section center viewpoint. As seen in FIG. 14, height HL for core 104 is preferably 1.5 to 6 inches with 2.8 inches (same as the width view maximum height for the core insert) being preferred; and the length L1 of core 104 is preferably 12 to 24 with 18.3 inches being well suited for the featured embodiment. Also core insert 104 has an upper and lower convex surface arrangement with a side edge curvature THETA produced by a mold peak to initiation of curvature taper of 0.75 inches. FIG. 14 also shows shell section 66 of a length L of 14 to 26 inches with 22 inches being well suited for the featured embodiment and rim 84 having thickness TL of 1.0 to 3.0 with 1.5 to 2.0 being more preferred and 1.8 most preferred in the embodiment featured. Thus, with reference again to FIG. 3, the rim thickness in the lengthwise direction is preferably about 5 to 20% of the total length L with 7 to 12% being preferred. The rim thickness TW in the widthwise direction of the shell section 66 is preferably essentially the same value across its surface for both the length and width rim portions with a percentage of a rim width preferably being 8 to 20% of length WS and more preferably 1 to 5% greater than the percentage value in the length direction. The recess depth is preferably about 25 to 75% of the overall depth thickness TS as in a ½ to ¾ inch deep recession and a 1 inch thick foam shell base layer therebelow.

FIG. 15 shows the two shell sections 66, 76 assembled together and with core insert 104 snugly received therein as in an above/below contact relationship (when the assembly is stacked free of the corresponding cover layers) between the shell sections and the interior core when the respective rims of the shell sections are in their final pre-head-compressed pillow state (shown as abutting in FIG. 15, but there would be thin cover layers in actual usage sandwiched therebetween but a similar relationship would exist in view of the preferred thinness of the interior cover layers for holding the shell sections). FIG. 15 further shows the overall shell 67 maximum height TP which essentially matches (noting the low percentage taken up by the exterior cover material) the preferred height values for the pillow as in 3 to 7 inches with 5 inches being well suited.

Figure 16:
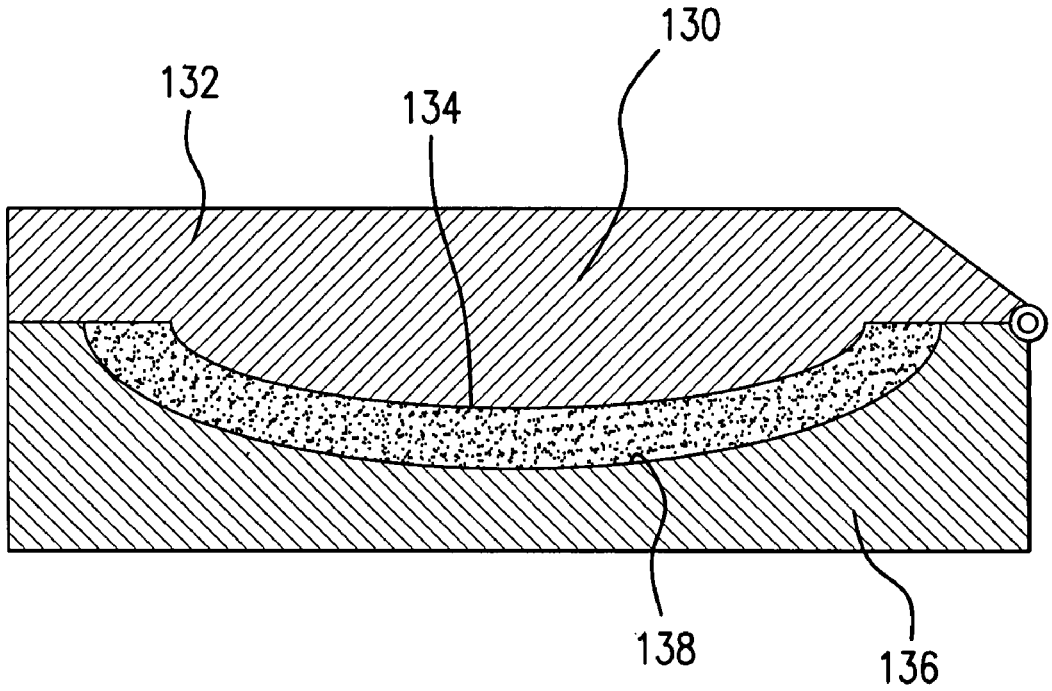
FIG. 16 illustrates, in cross section, a mold for formation of a shell section.
Figure 17:
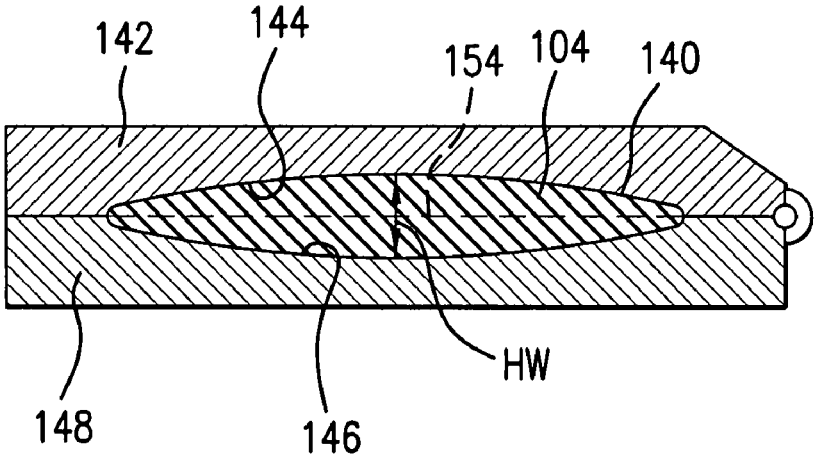
FIG. 17 illustrates, in cross section, a mold for formation of a solid foam body inner core insert.

FIG. 16 shows one method of forming shell sections 66 and 76 which involves molding of the shell sections. As seen mold 130 has hinged cover 132 with an inward extension (shown solid but could be in indented lid) 134 which is shaped to provide the recessed region 86, 86' in the noted shell sections. The bottom mold half 136 has an upper surface 138 which defines the exterior surface 94 of the shell sections. Thus visco-elastic foam or other setting material production chemicals can be inserted into the mold and allowed to set and then released preferably with the assistance of suitable intermediate separation liner material. One mold is shown in FIG. 16 and in view of the preference for a common shape and size for core sections 66, 76, it can be the same mold design for both shell sections. In practice, a universal one shape approach for the shells is desired, and thus a carousel or conveyor train of molds of similar multi-mold production means is featured under the method of shell section formation under the present invention (although one or the other shell sections can be altered in shape to be different than the other in a non-universal approach). It is preferable to provide a universal mold approach to the different core inserts as well when they are all formed of a foam or other moldable material. Thus, it is preferable to provide a similar shaped core reception cavity as shown, although an alternate core reception shape can be provided to accommodate differently shaped core inserts within a set. FIG. 17 shows an example of a core insert mold assembly 140 for forming solid body core insert 104 (as well as preferably core inserts 110 and 112) having cover 142 shown with a mirror image recess 144 relative to recess 146 formed in lower mold half 148.

Figure 18:
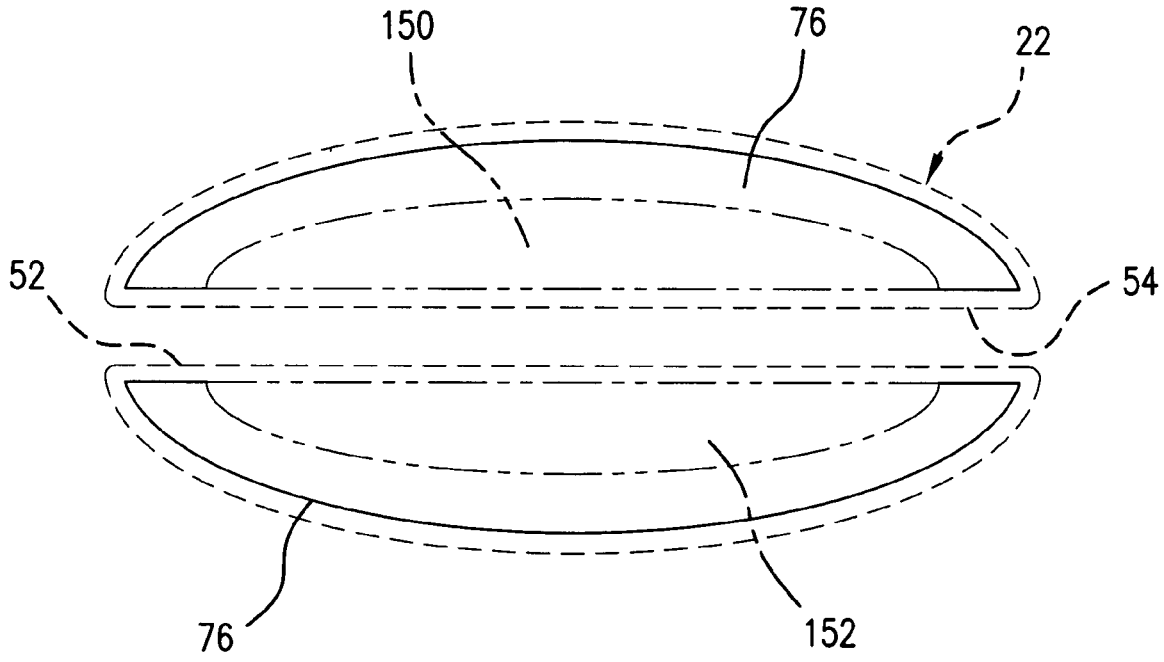
FIG. 18 shows an alternate embodiment of the invention featuring core inserts that are half of the core inserts utilized in the embodiment above and are positioned between the closest cover layer and the receiving shell section's recess.

FIG. 18 illustrates an alternate embodiment of the present invention having the same cover 22 as described above but featuring a core half stacking arrangement wherein the core insert to be received in the cavity formed by the stacked shell sections is comprised of two core insert members 150 and 152 that when combined together fill in the shell cavity. Thus, shell sections are provided in the same manner as described above but the core insert is formed by, for example, a similar mold as shown in FIG. 17 only with a flat topped lid as represented by dashed line 154. Thus sets of core insert members like 150 and 152 (reference to "core insert" herein can be in reference to fully filling cavity core inserts or partially filling shell cavities but "member" is being used here to help differentiate the discussion relative to core inserts like core insert 104) can be provided to the user as part of the above noted kit providing even greater flexibility in adjusting comfort level including above and below comfort differential. However, the addition of greater in number component parts makes for the kit like that shown in FIG. 6 more preferable. The core inserts 150 and 152 can however be inserted together with the shell section during pocket insertion or a user can reach into the same pocket for insertion after shell insertion and thus the interior layers are in direct abutment in the center once the shell assembly is assembled as opposed to the core being between the two folded over interior layer sections as featured in the earlier embodiment.

As seen from the above discussion, the present invention is readily assembled and broken down such that it provides for ease in cleaning. The cover would be subject to the greatest potential contact and is readily removed from all other pillow components as in zippering it open and removing the core insert and then sliding out the shell sections whereupon the cover can either be machine washed or readily dry cleaned which allows for prolonged use and also provides for a clean pillow potential between each use as would be desirable in a hotel setting. The core insert covers would also be subject to some handling and thus they too can also be readily cleaned when the interior core component is removable as in a solid foam body. Also because of the strong user preference for a particular comfort level, the means for adjusting-to-accommodate feature of the present invention provides for a guest facility as in a hotel to promote added accommodation to guests in providing the ability to pre-choose a desired pillow comfort level (e.g., a telephone or internet based choosing as in mouse clicking on a category that appears on a computer screen in similar fashion as may be chosen a double bed or king size bed on a hotel web site or based as a survey card left in the room, etc.) before arriving or upon arriving. Comfort level variation can be accommodated by switching out the type of core insert based on a central core insert supply location or the user or hotel servicer can store in the hotel room closet or the like the different core inserts and the guest or hotel service personnel can switch it out to the desired setting.

What is claimed is:

1. A cushioning device comprising:

a cover having an exterior layer and an interior layer, said interior layer and said exterior layer being connected together with attachment means for securing a portion of the interior layer to a portion of the exterior layer as to define between said interior layer and said exterior layer first and second pockets and so as to define a pivot between said first and second pockets for relative pivoting of said first and second pockets about said pivot, said first pocket including an access opening, and said second pocket including an access opening:

closure means which provides for adjustable placement of said cover in a cover interior cavity closure state and a cover interior cavity access state;

a first foam shell section being releasably received in said first pocket and being insertable and removable relative to the access opening in said first pocket;

a second foam shell section being releasably received in said second pocket and being insertable and removable relative to the access opening in said second pocket;

an insert core received within said cover interior cavity and within a preformed recess of said foam shell sections.

2. The cushioning device of claim 1 wherein said exterior layer is comprised of a single sheet of material with an intermediate fold section and said closure means comprises a zipper runner that extends along an unfolded side edge of said exterior layer.

3. The cushioning device of claim 1 wherein said shell sections each have a rim portion and when said closure means is in a closed state said rim portions are in an adjacent corresponding juxtaposed relationship with said core insert received in nesting fashion within respective preformed recessed sections of said first and second shell sections.

4. The cushioning device of claim 3 wherein said interior layer is folded upon itself when said closure means has said cover in said interior cavity closure state and wherein respective sections of said interior layer defining said pockets are sandwiched between said juxtaposed rim portions of said shell sections and wherein said access openings are positioned inward of the sandwiched, respective sections of said interior layer when said closure means is in said interior cavity closure state.

5. The cushioning device as recited in claim 3 wherein said rim has a thickness relative to overall length of said shell section of 5 to 20% and said insert core is dimensioned as to fill at least 90%, while in a state of non-compression, of an area represented by an interior edge of one of said rims and at least 80% of a maximum area occupied by a periphery of said cushion, and wherein said rims have planar rim sections that are in a parallel stacked arrangement when the closure means is in the interior cavity closure state.

6. The cushioning device as recited in claim 1 wherein said cushion device is a head pillow and said shell sections are each of a common shape and dimension and have matching rims which are placed in a stacked state to define a mirror image pair of preformed reception recesses within which said insert core is fully received.

7. The cushioning device as recited in claim 1 wherein said interior layer is rectangular in shape and has an intermediate connection strip connected to a corresponding intermediate area of said exterior layer to define a common interior edge of said first and second pockets, and said access openings being formed by a slot in said interior layer extending transversely away from said connection strip to shorter respective opposite ends of the rectangular interior layer, and wherein said slot is positioned closer to one of the longer edges of said rectangular interior layer than the opposite longer edge.

8. The cushioning device of claim 1 wherein said attachment means defines a first peripheral portion of said cushioning device, and said interior layer and said exterior layer have peripheral edging attached together by said closure means and defining a second peripheral portion of said cushioning device that is removed from said first peripheral portion of said cushioning device.

9. The cushioning device of claim 8 wherein said closure means comprises stitching extending through each of said interior layer and said exterior layer in defining said second peripheral portion.

10. A pillow kit comprising:

a cushioning device having;

a cover having an exterior layer and an interior layer, said interior layer and said exterior layer being connected together with attachment means for securing a portion of the interior layer to a portion of the exterior layer as to define therebetween first and second pockets, said first pocket including an access opening, and said second pocket including an access opening, closure means which provides for adjustable placement of said cover in a cover interior cavity closure state and a cover interior cavity access state, and wherein said attachment means defines a first peripheral portion of said cushioning device, and said interior layer and said exterior layer have peripheral edging that are fastened together by said closure means as to define a second peripheral portion of said cushioning device that is removed from said first peripheral portion of said cushioning device, a first foam shell section being releasably received in said first pocket and being insertable and removable relative to the access opening in said first pocket, and said first shell section comprising an outer rim section and a preformed cavity positioned inward of said rim section, a second foam shell section being releasably received in said second pocket and being insertable and removable relative to the access opening in said second pocket, and said second shell section comprising an outer rim section and a preformed cavity positioned inward of the rim section of the second shell section, and said kit further comprising a first insert core dimensioned for reception within said cover interior cavity and within the preformed cavity defined by said shell sections, and a second insert core dimensioned for receipt in said cover interior cavity in place of said first insert core, and said first and second insert cores having different comfort characteristics.

11. The kit of claim 10 further comprising a third insert core for receipt in said cover interior cavity in place of each of said first and second cores, and said third insert core having a different comfort characteristic than each of said first and second cores.

12. The kit of claim 11 wherein said first, second and third cores are each of a foam material.

13. The kit of claim 12 wherein said first, second and third insert cores have an 25% IFD value of from (a) 5 to 10 lb, (b) 8 to 14 and (c) 12 to 20 respectively, with an IFD relationship amongst the insert cores of $a<b<c$.

14. The kit of claim 12 wherein said first, second and third insert cores have a density value of from (a) 4 to 6 PCF, (b) 2 to 5 PCF, and (c) 1.5 to 3.0 PCF respectively, with a density relationship amongst said insert cores being $a>b>c$.

15. The kit of claim 11 wherein said first insert core is of a visco elastic foam, and at least one of said second and third insert cores is of a material other than visco elastic foam.

16. The kit of claim 15 wherein at least one of said second and third insert cores includes a multitude of individual filler elements within a core covering which is received in said shell sections.

17. The kit of claim 16 wherein said individual filler elements include a fiber material.

18. The kit of claim 11 wherein said at least one of said first, second and third insert cores includes an air bladder and another of said cores includes a foam material insert core.

19. The kit of claim 11 wherein said first, second and third cores comprising an interior insert material and an outer covering placed in contact with the interior layer of said cover when said closure means is in said interior cavity closure state.

20. The kit of claim 11 wherein each of said first, second and third insert cores are of a different material and of a common shape and size.

21. The kit of claim 10 wherein said closure means comprises stitching extending through each of said interior layer and said exterior layer in defining said second peripheral portion.

22. The kit of claim 10 wherein said attachment means defines a pivot at the first peripheral portion as to provide for relative pivoting of said first and second pockets in notebook fashion.

23. A cushioning device comprising:

a cover having an exterior layer and an interior layer, said interior layer and said exterior layer being directly secured together with attachment means for securing a portion of said interior layer to said exterior layer as to define therebetween first and second pockets, said first pocket including an access opening, and said second pocket including an access opening:

closure means which provides for adjustable placement of said cover in a cover interior cavity closure state and a cover interior cavity access state;

a first shell section being releasably received in said first pocket and being insertable and removable relative to the access opening in said first pocket;

a second shell section being releasably received in said second pocket and being insertable and removable relative to the access opening in said second pocket;

an insert core received within said cover interior cavity, and wherein said interior layer includes an intermediate fold section joined with an intermediate fold section of said exterior layer by said attachment means so as to define a hinge location for said first and second pockets, and peripheral edging of said interior layer is connected with peripheral edging of said exterior layer, and said interior layer is of a larger area than said exterior layer such that a looseness is provided for pocket cavity formation.

24. The cushioning device of claim 23 wherein said interior layer is formed of two parallel strips of material with said access openings being defined by adjacentmost edging of said two parallel strips, which adjacentmost edging of said parallel strips are unfastened relative to each other as to provide for quick access to said shell sections through the unfastened access openings.

25. The cushioning device of claim 24 wherein said strips have overlapping adjacentmost edging.

26. A head pillow comprising:

a cover, said cover having an exterior layer and an interior layer connected about corresponding peripheral edge regions, and said interior layer having an intermediate area connected to a corresponding intermediate area of said exterior layer by attachment means for securing said intermediate areas together so as to divide said interior layer into first and second pockets, with each pocket having an access opening;

a first shell section formed of a foam body with a preformed reception recess formed on a first side and bounded by a rim section;

a second shell section formed of a foam body with a preformed reception recess formed on a first side and bounded by a rim section;

said first shell section being received, by way of the access opening, within said first pocket and being adaptable for removal from said first pocket by way of the access opening in said first pocket;

said second shell section being received, by way of the access opening, within said second pocket and being adaptable for removal from said second pocket by way of the access opening in said second pocket;

said interior layer having an above layer section and a lower layer section defining a cavity;

a core insert being received between said upper and lower layer sections of said interior layer within said cavity and within the preformed reception recesses formed in said shell sections with said rims of said shell sections being in a stacked arrangement with said interior layer sandwiched between said rim sections;

closure means for closing off the cavity in a cover closure mode and for rendering accessible the cavity in said cover open mode for insertion or removal of said core insert, and wherein said attachment means defines a first peripheral portion of said cushioning device and said interior and exterior layers have peripheral edging fastened together by said closure means as to define a second peripheral portion of said cushioning device that is removed from said first peripheral portion of said cushioning device.

27. The pillow of claim 26 wherein said access openings are positioned radially internally of an interior edge of said rims when the cavity is closed by said closure means.

28. The head pillow of claim 26 wherein said attachment means defines a pivot at the first peripheral portion as to provide for relative pivoting of said first and second pockets in notebook fashion.

29. A method for assembling a cushion device, comprising;

inserting a first shell section within an access opening of a first pocket provided in an interior layer of a combination interior and exterior layer cover, which combination includes attachment means for direct securement of a portion of the interior layer of the cover to a portion of the exterior layer of said cover to define said first pocket, said first shell section having a recessed region surrounded by a rim region;

inserting a second shell section within an access opening of a second pocket provided in the interior layer of the combination interior and exterior layer cover, said second shell section having a recessed region surrounded by a rim region;

inserting a core insert within the recessed region of one of said shell sections, said core insert having a different comfort characteristic than that of at least one of said shell sections;

folding said cover along a hinge defined by said attachment means to place said shell sections in a stacked state with said rim regions facing each other to form a shell cavity within which said insert core is positioned; and connecting together folded cover sections to retain the stacked state of said shell sections, and with said access openings being spaced radially inward of a connected periphery of said cover sections such that the access openings contact respective upper and lower surfaces of said core insert.

30. The method of claim 29 wherein said access openings are spaced radially inward of an interior peripheral edge of said rim regions, and wherein said interior layer has a larger peripheral area than that of said exterior cover layer in regions of each of said first and second pockets to facilitate insertion and removal of said shell sections relative to said pockets.

* * * * *